US007820349B2

(12) United States Patent
Takagi et al.

(10) Patent No.: US 7,820,349 B2
(45) Date of Patent: Oct. 26, 2010

(54) TONER FOR ELECTROSTATIC LATENT IMAGE DEVELOPMENT, PRODUCTION METHOD THEREOF, AND DEVELOPER FOR ELECTROSTATIC LATENT IMAGE DEVELOPMENT

(75) Inventors: Seiichi Takagi, Kanagawa (JP); Takashi Imai, Kanagawa (JP); Susumu Yoshino, Kanagawa (JP); Katsumi Daimon, Kanagawa (JP); Emi Takahashi, Kanagawa (JP); Toyofumi Inoue, Kanagawa (JP); Yasushige Nakamura, Kanagawa (JP); Isao Ito, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 658 days.

(21) Appl. No.: 11/504,713

(22) Filed: Aug. 16, 2006

(65) Prior Publication Data

US 2007/0207402 A1 Sep. 6, 2007

(30) Foreign Application Priority Data

Mar. 1, 2006 (JP) ..... 2006-055593

(51) Int. Cl.
*G03G 9/093* (2006.01)

(52) U.S. Cl. ..... 430/108.1; 430/110.1; 430/110.2; 430/138; 430/350; 430/351

(58) Field of Classification Search ..... 430/108.1, 430/110.1, 110.2, 138, 350, 351
See application file for complete search history.

(56) References Cited

U.S. PATENT DOCUMENTS 5,015,549 A * 5/1991 Grosso et al. ..... 430/107.1
6,740,465 B2 * 5/2004 Liang et al. ..... 430/138
2004/0076897 A1 * 4/2004 Kawada et al. ..... 430/45

FOREIGN PATENT DOCUMENTS

| | | |
|---|---|---|
| JP | A 61-028957 | 2/1986 |
| JP | A 61-046955 | 3/1986 |
| JP | A 2-293869 | 12/1990 |
| JP | A 4-211252 | 8/1992 |
| JP | B2 2979158 | 11/1992 |
| JP | A 8-106172 | 4/1996 |
| JP | A-08-248673 | 9/1996 |
| JP | A 11-002922 | 1/1999 |

(Continued)

OTHER PUBLICATIONS

Machine English language translation of JP 8106172, Apr. 23, 1996.*

(Continued)

*Primary Examiner*—Hoa V Le
(74) *Attorney, Agent, or Firm*—Oliff & Berridge, PLC

(57) ABSTRACT

The invention provides a toner for electrostatic latent image development comprising a first component and a second component which are isolated from each other and capable of forming a color when the first component and the second component are brought into reaction with each other, and a photo-curable composition containing either the first component or the second component, the photo-curable composition not being capable of forming a color when the photo-curable composition is not cured, that is irreversibly controlled to a state of being capable of forming a color by irradiating light having a specific wavelength at which the photo-curable composition is cured.

29 Claims, 2 Drawing Sheets

FOREIGN PATENT DOCUMENTS

| | | |
|---|---|---|
| JP | A 11-002923 | 1/1999 |
| JP | B2 3661422 | 3/1999 |
| JP | A 2000-199952 | 7/2000 |
| JP | A 2003-330228 | 11/2003 |
| JP | A 2004-45660 | 2/2004 |
| JP | A 2005-255987 | 9/2005 |

OTHER PUBLICATIONS

Machine English language translation of JP 2003330228, Nov. 19, 2003.*

Aug. 17, 2010 Office Action issued in Japanese Application No. 2006-055593 (with translation).

* cited by examiner

TONER FOR ELECTROSTATIC LATENT IMAGE DEVELOPMENT, PRODUCTION METHOD THEREOF, AND DEVELOPER FOR ELECTROSTATIC LATENT IMAGE DEVELOPMENT

BACKGROUND (i) Technical Field

The present invention relates to a toner for electrostatic latent image development used for forming an image by electrophotography such as a copying machine, a production method thereof, and a developer for electrostatic latent image development using the toner for electrostatic latent image development.

(ii) Related Art

In recent years, due to advances in information technology and increased environmental concerns, more space-saving, resource-saving color image printers having reduced size and weight are required for business use. For this reason, there have been advancements in speed and adaptability to plain paper in color image printers such as inkjet, thermal transfer and sublimation printers, which are fundamentally easy to reduce the size and weight thereof.

However, an electrophotographic system is still predominantly used in offices for its inherent properties such as high speed printing and adaptability to plain paper, even with the difficulty in reducing the size and weight thereof compared to the above-described type of printers. In the electrophotographic system, a tandem-type image forming device, equipped with four image forming units of different colors respectively comprising a photosensitive body and a developing equipment which perform latent image formation, development and transfer, is a typical image forming apparatus which prints color images at high speed.

Since this apparatus has the image forming units of respective colors, images of C (cyan), M (magenta), Y (yellow) and K (black) can be formed almost simultaneously, and thereby printing speed can be improved. However, since four image forming units having the same function are used, the apparatus cannot be reduced in size and weight.

Therefore, in order to enable color image formation in a single image forming unit, a toner which develops necessary colors with one kind of toner particle has been proposed. A fundamental principle of the color development of the toner is to react a dye precursor with a developer by means of an external stimulation corresponding to an image information, thereby forming the necessary colors.

The toner utilizes the technique of a recording paper which is pre-coated with an ink layer containing microcapsules which are responsive to an external stimulation such as light or heat.

For example, there have been suggested particles in which plural microcapsules having a capsule wall which changes the substance permeability thereof when subjected to an external stimulation are dispersed and mixed into a toner resin. In the particles, one of two kinds of reactive substances (dye precursor of respective colors) which cause a color developing reaction when mixed with each other is contained in microcapsules, and the other (developer) is contained in a toner resin which is outside the microcapsules.

By using a photoisomerizing substance which increases the substance permeability thereof when irradiated by light having a specified wavelength as a capsule wall, or by using a capsule wall which is destructed when a supersonic wave of a resonance frequency is applied, the toner forms a color due to the reaction of two kinds of reactive substances existing inside and outside the microcapsules, when light or a supersonic wave is applied.

On the other hand, as a process of preparing a toner, a process called a wet method such as a polymerization method, an in-liquid drying method and an emulsion aggregation method has recently been put into practical use from the viewpoint of environmental concerns and further improvement in functions. As these methods of preparing a toner do not require a high temperature and a high degree of shearing force as compared with conventional methods such as a kneading-pulverizing method, materials which have been conventionally difficult to utilize for a toner can also be used.

Although a toner which develops a color when an external stimulation such as light is applied has an advantage of being capable of forming a favorable full color image using an apparatus having a simpler construction and reduced size and weight, as compared with a case where the conventional toner containing a coloring agent such as a pigment is used, specific preparing process thereof is not practically described. That is, actually, a toner of a type that responds to an external stimulation to form a color without using a coloring agent is yet to be realized.

It is reported that, when a capsule wall of microcapsules contains a photoisomerizing substance, progression of color formation can be stopped by applying a light stimulation again to close an opening of a capsule wall, after the image is formed.

However, the substance permeability of a capsule wall comprising a light-responsive photoisomerizing substance is controlled by utilizing a photoisomerization reaction. For this reason, when a toner is stored for a long period of time, there is a possibility that a toner spontaneously forms a color. In addition, since the image is exposed to light stimulation such as an indoor fluorescent lamp or sunshine after the image is formed, it could also be expected that opening of the capsule wall will occur again depending on the intensity or wavelength of light. Therefore, when microcapsules which have a possibility of reversibly responding to a light stimulation, even after the image is formed, are contained in the image, there is a large possibility that a once formed image will change in color and deteriorate the color balance thereof.

Increase in substance permeability of a capsule wall caused by a photoisomerization reaction utilizes transition from the trans state to the cis state. However, such kind of reaction is reversible and a reaction of returning to the trans state from the cis state could occur at the time of image formation. Therefore, sufficient color formation may not be obtained in some cases.

Furthermore, when a capsule wall is destructed by an external stimulation such as a supersonic wave to form a color, color formation proceeds under an environment such as high temperature even after the image formation. Thus, there is also a possibility of deterioration in color balance of an image.

SUMMARY

According to an aspect of the invention, there is provided a toner for electrostatic latent image development comprising a first component and a second component which are isolated from each other and capable of forming a color when the first component and the second component are brought into reaction with each other, and a photo-curable composition containing either the first component or the second component, the photo-curable composition not being capable of forming a color when the photo-curable composition is not cured, that is irreversibly controlled to a state of being capable of forming a color by irradiating light having a specific wavelength at which the photo-curable composition is cured.

BRIEF DESCRIPTION OF THE DRAWINGS

Exemplary embodiments of the present invention will be described in detail based on the following figures, wherein.

Figure 1:
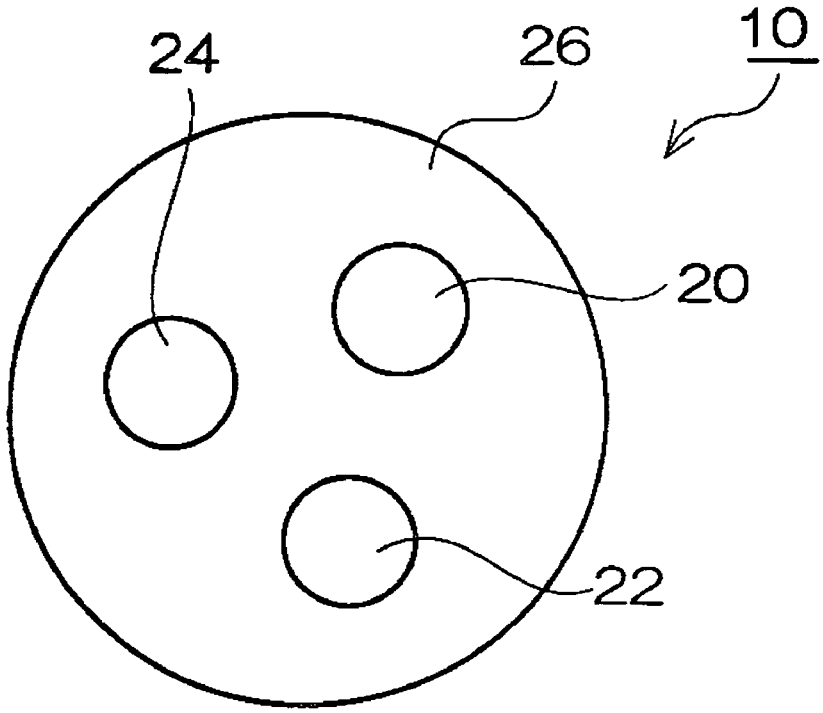
FIG. 1 is a schematic sectional view illustrating an example of the toner of the invention comprising a base material and color forming sections which are dispersed in the base material in the form of particles.

DETAILED DESCRIPTION (Toner for Electrostatic Latent Image Development)

The toner for electrostatic latent image development of the invention (hereinafter, abbreviated as "toner" in some cases) contains a color-changeable substance.

Therefore, by using the toner of the invention, an image can be formed without using conventional toners containing a coloring agent.

In the invention, "change in color" means at least one selected from a change in color tone from the state of lower coloring degree (or the colorless state) to the state of higher degree, change in color tone from the state of higher coloring degree to the state of lower degree (or the colorless state), and a change in color tone from the state of being colored in a color to the state of being colored in another color, or a combination of two or more kinds thereof, which occur when a stimulation such as light or heat is applied.

As the color-changeable substance, a color forming substance capable of forming a color, or a color fading substance capable of fading a color can be used. In the invention, it is particularly preferable to use a color forming substance capable of forming a color.

A color forming substance may be pre-colored in the state before a color is formed but particularly preferably a substance which is substantially colorless. The color forming substance preferably contains two or more kinds of components which form a color when they are reacted with each other, particularly preferably comprises a first component and a second component which form a color when they are reacted with each other. When a color is formed utilizing a reaction of two or more kinds of components, controlling the color formation can be made easier.

As a color fading substance, a substance which exhibits a specified color before fading the color is used, and the substance preferably contains two or more kinds of components which fade a color when they are reacted with each other, particularly preferably comprises a first component and a second component which fade a color when they are reacted with each other. Examples of a toner using the color fading substance include a toner containing three kinds of components which are previously colored in cyan, magenta and yellow. In this case, controlling change in color of the toner can be performed by fading a color of at least any one kind of the color fading substances.

Hereinafter, a case where a color forming substance is used as a color-changeable substance will be explained in more detail.

Controlling of a color forming substance from the state of not being capable of forming a color to the state of being capable of forming a color at the time of image formation is performed by applying an external stimulation. The kind of the external stimulation is not particularly limited here, but various physical, chemical or mechanical stimulations such as light irradiation, heat treatment, application of a supersonic wave and pressurizing can be utilized, and two or more kinds thereof may be combined.

However, in the invention, it is preferable that the external stimulation includes a color forming stimulation to allow a color forming substance in the state of being capable of forming a color to form a color, and a controlling stimulation to control a color forming substance to the state of being capable of forming a color or not being capable of forming a color before the color forming stimulation is applied.

In this case, it is preferable that the controlling stimulation is irradiation of light having a specified wavelength (hereinafter, referred to as "color forming information imparting light" in some cases), and the color forming stimulation is a heat treatment.

In the invention, for ease of controlling the color formation, it is preferable to use two or more kinds of components which form a color when they are reacted with each other, as a color forming substance. However, when these components are present in the same matrix where substance diffusion is easy, spontaneous color formation may proceed at the time of storage or preparation of the toner, even if no external stimulation is applied.

For this reason, it is preferable that each kind of these components is contained in each different matrix where substance diffusion into regions of each other is difficult as long as an external stimulation is not applied.

In order to inhibit substance diffusion when no external stimulation is applied to prevent spontaneous color formation at the time of storage or preparation of a toner, it is preferable that at least one of two or more kinds of components is contained in a first matrix and the remainder is contained outside the first matrix (second matrix), and a third matrix (usually a membrane), having a function of inhibiting substance diffusion between the first and second matrices as long as no external stimulation is applied, and when an external stimulation is applied, enabling substance diffusion between the first and second matrices depending on a kind, an intensity and a combination of stimulations, is provided between the first matrix and the second matrix.

In order to dispose respective kinds of components in a toner by means of the three matrices, it is preferable to utilize microcapsules.

In this case, in the toner of the invention, at least one of two or more kinds of component is contained in the microcapsules and the remaining kinds of component are contained outside the microcapsules. When two or more kinds of component comprise a first component and a second component, it is particularly preferable that any one of them is contained in the microcapsules and the other is contained outside the microcapsules. In this case, the interior of microcapsules corresponds to a first matrix, an outer shell of microcapsules corresponds to a third matrix, and the exterior of microcapsules corresponds to a second matrix.

Such microcapsules are not particularly limited as long as they have a core part and an outer shell coating the core part, and inhibit diffusion of the substance inside and outside the microcapsules as long as no external stimulation is applied, and when external stimulation is applied, enable substance diffusion between inside and outside the microcapsules responding to a kind, intensity or a combination of stimulation. The core part contains at least one of two or more kinds of component.

The microcapsules may be the ones in which substance diffusion between inside and outside thereof is enabled by applying a stimulation such as light irradiation or a pressure, but particularly preferred ones are thermally responsive microcapsules in which substance diffusion between inside and outside thereof is enabled (substance permeability of an outer shell is increased) by a heat treatment.

Substance diffusion between inside and outside the microcapsules enabled by applying a stimulation is preferably irreversible from a viewpoint of suppressing deterioration of color concentration at the time of image formation and change in color balance of an image being left under a high temperature environment. For this reason, it is preferable that an outer shell constituting the microcapsules has a function of irreversibly increasing substance permeability thereof by softening, degradation, dissolution (mutual dissolution into the surrounding materials) or deformation caused by applying a stimulation such as a heat treatment or light irradiation.

Explained now is a case where a first component and a second component which form a color when they are reacted with each other are used in the toner of the invention, as two or more kinds of component.

In this case, the toner of the invention comprises the first component and the second component which are present in the state of being isolated from each other and form a color when they are reacted with each other, and a photo-curable composition containing either the first component or the second component.

As the toner described above, there are (1) a type which maintains a state of not being capable of forming a color when the photo-curable composition is uncured, and is controlled irreversibly from the state of not being capable of forming a color to the state of being capable of forming a color by irradiating light having a specified wavelength at which the photo-curable composition is cured to cure the photo-curable composition (hereinafter, referred to as a "photo-developable toner" in some cases), and (2) a type which maintains a state of being capable of forming a color when the photo-curable composition is uncured, and is irreversibly controlled from the state of being capable of forming a color to the state of not being capable of forming a color by irradiating light having a specified wavelength at which the photo-curable composition is cured to cure the photo-curable composition (hereinafter, referred to as a "non-photo-developable toner" in some cases). Details of these two types of toners will be described later.

When microcapsules are further used in a toner having a first component and a second component which are present in the state of being isolated from each other and form a color when they are reacted with each other, and a photo-curable composition containing either the first component or the second component, the toner is preferably any one of (1) an embodiment in which the toner contains microcapsules dispersed in the photo-curable composition, and the first component and the second component are respectively contained in the microcapsules and the photo-curable composition (hereinafter, referred to as a "first embodiment" in some cases), (2) an embodiment in which the second component is contained in the microcapsules and the first component is contained in the photo-curable composition (hereinafter, referred to as a "second embodiment" in some cases), and (3) an embodiment in which both of the first component and the second component are respectively contained in the microcapsules, and the photo-curable composition is contained in either the microcapsules containing the first component or the microcapsules containing the second component (hereinafter, referred to as a "third embodiment" in some cases).

Among these three embodiments, particularly preferred is the first embodiment. Detailed explanation of the toner of the invention is fundamentally premised on the toner of the first embodiment. However, the construction, material, preparation method or the like of the toner of the first embodiment can also be utilized in, or converted to, the toners of the second and the third embodiments, as a matter of course.

The microcapsules are particularly preferably thermal-responsive microcapsules which enable substance diffusion between inside and outside the microcapsules when subjected to a heat treatment. In a case where a photo-curable composition can be cured by irradiating color forming information imparting light, combination of cases of irradiating or not irradiating the color forming information imparting light (applying or not applying controlling stimulation) with a heat treatment (applying color forming stimulation) can be utilized as the external stimulation.

Specifically, in this case, the external stimulation which is applied for controlling the reaction between the first component and the second component (controlling color forming reaction) includes a color forming stimulation to bring the first component and the second component which are both in the state of being capable of forming a color into reaction (color forming reaction), and a controlling stimulation to control the reaction between the first component and the second component into the state of being capable of forming a color or not being capable of forming a color when the color forming stimulation is applied, prior to applying the color forming stimulation. Irradiation of the color forming information imparting light is used as the controlling stimulation, and a heat treatment is used as the color forming stimulation.

Thermal-responsive microcapsules (hereinafter, simply abbreviated as "microcapsules" in some cases) comprise a core part containing a first component, and an outer shell coating the core part, and it is preferable that a material constituting the outer shell comprise a thermal-responsive material which enables substance diffusion inside and outside the microcapsules by means of a heat treatment. In this case, it is preferable to use a material by which the state where substance diffusion between inside and outside the microcapsules is easy is permanently (irreversibly) maintained by degradation, disappearance or destruction of the outer shell structure which are caused by degradation, softening or mutual dissolution with the surrounding materials due to the heat treatment (e.g. a thermally degradable material which is degraded by heating, a thermoplastic material such as a thermoplastic resin, a thermal-soluble material which is compatible with a surrounding member by heating, etc.), after the heat treatment is completed.

Non-Photo-Developable Toner

A non-photo-developable toner will now be explained in detail.

As described above, a non-photo-developable toner has a function of maintaining the state of being capable of forming a color when a photo-curable composition is in the uncured state, and is irreversibly controlled from the state of being capable of forming a color to the state of not being capable of forming a color by irradiating light having a specified wavelength at which the photo-curable composition is cured to cure the photo-curable composition.

In order to attain the above function, it is preferable that a second component contained in the photo-curable composition is a substance having a photopolymerizable group in the molecule thereof. In addition, it is more preferable that a photopolymerization initiator is contained, and other components may further be contained, as appropriate.

In the non-photo-developable toner, the second component itself has photopolymerizability. Therefore, the state where substance diffusion of the second component contained in the photo-curable composition is easy can be maintained, even when color forming information imparting light is irradiated, as long as the wavelength of the color forming information imparting light to be irradiated is not a wavelength at which the photo-curable composition is cured. In this state of things, by applying a color forming stimulation such as a heat treatment to increase substance permeability of the outer shell of the microcapsules, the state where the reaction between the first component in the microcapsules and the second component in the photo-curable composition (color forming reaction) is enabled (state of being capable of forming a color) is realized.

To the contrary, since when a photo-curable composition is cured by irradiating color forming information imparting light having a wavelength of curing a photo-curable composition, the second component contained in the photo-curable composition is polymerized and substance diffusion of the second component contained in the photo-curable composition becomes extremely difficult. For this reason, even when a stimulation to increase substance permeability of a microcapsule outer shell is applied in this state, the second component cannot contact with the first component in the microcapsules, and the state where reaction between the first component and the second component (color forming reaction) is impossible (state of not being capable of forming a color) is maintained.

Since reaction of curing the photo-curable composition is irreversible, once the state is controlled to the state of not being capable of forming a color, this state is permanently maintained.

Therefore, for example, when thermal-responsive microcapsules are used as the microcapsules, by irradiating color forming information imparting light to cure the photo-curable composition and controlling the toner to the state of not being capable of forming a color, the first component and the second component cannot react with each other even if the toner is subsequently subjected to a heat treatment to increase substance permeability of the thermal-responsive microcapsule outer shell. Therefore, for example, if the color of the toner before color formation is colorless and transparent, such state is stably maintained.

On the other hand, when the toner is heat-treated in the state where the photo-curable composition is uncured, i.e. in the state where the toner can form a color, substance permeability of the thermal-responsive microcapsule outer shell is increased and the first component and the second component are reacted to each other, the toner forms a predetermined color, and the state where the color is formed can stably be maintained.

In the non-photo-developable toner, the color forming reaction between the first component and the second component is controlled by a process substantially comprising a single step in which substance permeability of the microcapsule outer shell is increased by applying color forming stimulation such as a heat treatment when the photo-curable composition is uncured (when the toner is not subjected to a process of irradiating color forming information imparting light having a wavelength of curing a photo-curable composition).

Therefore, it is easy to control the color forming reaction, secure the color concentration at the time of image formation, or suppress the change in color balance after image formation. In addition, by making the increase in substance permeability of the microcapsule outer shell irreversible, controlling with more precision becomes possible. Furthermore, since gradation of color concentration can be controlled by adjusting the degree of curing (polymerization) of the photo-curable composition, which is irreversible, it is also extremely easy.

To prevent a toner from forming a color, by irradiating color forming information imparting light to cure the photo-curable composition before applying color forming stimulation such as a heat treatment to increase substance permeability of the microcapsule outer shell, the state of being not capable of forming a color can stably be maintained.

-Photo-Developable Toner-

A photo-developable toner is now explained in more detail.

The photo-developable toner has a function of maintaining the state of not being capable of forming a color when a photo-curable composition is uncured and curing a photo-curable composition by irradiating light having a specified wavelength of curing the photo-curable composition to control the photo-curable composition irreversibly from the state of not being capable of forming a color to the state of being capable of forming a color.

In order to attain such kind of function, it is preferable that at least a second component (having no photopolymerizability) and a photopolymerizable component. It is more preferable that a photopolymerization initiator is contained, and if necessary, other components may further be contained.

For the photopolymerizable compound and the second component used for a photo-developable toner, a material in which interaction between the photopolymerizable compound and the second component occurs to suppress substance diffusion of the second component in the photo-curable composition, when the photo-curable composition is in the state of being uncured, and the interaction between them decreases to make substance diffusion of the second component in the photo-curable composition easy, after the photo-curable composition is cured due to irreversible curing reaction by irradiating color forming information imparting light (polymerization of photopolymerizable compound), are used (details of the material constituting the photo-curable composition will be described later).

Therefore, in the photo-developable toner, the second component remains being trapped in the photopolymerizable compound when the color forming information imparting light is not irradiated and the photo-curable composition is in the state of being uncured. For this reason, even if a stimulation to increase substance permeability of the microcapsule outer shell is applied in this state, the second component cannot contact the first component in the microcapsules and the state where reaction between the first component and the second component (color forming reaction) is not possible (state of not being capable of forming a color) is maintained.

On the other hand, by irradiating color forming information imparting light having a wavelength at which the photo-curable composition is cured to cure the photo-curable composition, substance diffusion of the second component contained in the photo-curable composition is made easy. Therefore, by applying a color forming stimulation such as a heat treatment in this state, substance permeability of the microcapsule outer shell is increased and the a reaction (color forming reaction) between the first component contained in the microcapsules and the second component contained in the photo-curable composition is enabled (the state of being capable of forming a color is enabled).

Since the curing reaction of the photo-curable composition is irreversible, the state of being capable of forming a color is permanently maintained once the photo-developable toner is controlled to a state of being capable of forming a color.

Therefore, for example, when thermal-responsive microcapsules are used for the microcapsules, by irradiating color forming information imparting light to cure the photo-curable composition to control the toner to be in the state of being capable of forming a color, then conducting a heat treatment, substance permeability of the thermal-responsive microcapsules is increased and the first component and the second component are brought into reaction to allow the toner to form a predetermined color, and such state of forming a color can stably be maintained. On the other hand, if the color forming information imparting light to cure the photo-curable composition is not irradiated, the photo-curable composition maintains the state of being uncured, and even if a heat treatment is conducted and substance permeability of the thermal-responsive microcapsule outer shell is increased, the first component and the second component cannot be brought into reaction. Therefore, for example, when the color of the toner before forming a color is colorless and transparent, such state is stably maintained.

In the photo-developable toner, the color forming reaction between the first component and the second component is controlled by two steps of (1) reaction to cure the photo-curable composition by irradiating color forming information imparting light having a wavelength at which the photo-curable composition is cured, and (2) increase in substance permeability of the microcapsule outer shell caused by applying a color forming stimulation such as a heat treatment.

Since the second step of the color forming reaction can be controlled without being affected by the first step of the process, it is easy to control color forming reaction, secure the color concentration at the time of image formation and suppress the change in color balance after the image formation. In addition, by making increase in substance permeability of the microcapsule outer shell irreversible, control with more precision can be conducted. Controlling of the gradation of color concentration is extremely easy because it can be controlled by adjusting the degree of curing (polymerization), which is irreversible, of the photo-curable composition.

The photo-developable toner may be a type using a photopolymerizable compound having a property of trapping the second component when the photo-curable composition is in the state of being uncured (hereinafter, referred to as a "first photo-developable toner" in some cases), as described above, or a type using a photopolymerizable compound having a color-fading reaction group that inhibits a color forming reaction between the first component and the second component by reacting with the first component, in the molecule thereof (hereinafter, referred to as a "second photo-developable toner" in some cases).

In the second photo-developable toner, for example, in a case where thermal-responsive microcapsules are used, the photo-curable composition is cured (i.e. a photopolymerizable compound containing a color fading reaction group is polymerized) when color forming information imparting light having a wavelength at which the photo-curable composition is cured is irradiated, and even if a heat treatment is subsequently performed, a color can be formed since color forming reaction between the first component and the second component is not inhibited by the color fading reaction group (which cannot undergo substance-diffusion even when heated, due to polymerization). To the contrary, when a heat treatment is performed without irradiating color forming information imparting light having a wavelength at which the photo-curable composition is cured, a color cannot be formed since the color fading reaction group reacts with the first component to inhibit color forming reaction between the first component and the second component.

As mentioned above, in the second photo-developable toner, the state of being not capable of forming a color is maintained when the photo-curable composition is in the state of not being cured, and the state of not being capable of forming a color is controlled to the state of being capable of forming a color by irradiating light having a wavelength at which the photo-curable composition is cured and curing the photo-curable composition -Structure of the Toner- A preferable structure of the toner of the invention will now be explained in more detail, with regard to the case where the toner of the invention contains the aforementioned photo-curable composition and microcapsules dispersed in the photo-curable composition.

The toner of the invention may have only one color forming section containing a photo-curable composition and microcapsules which is dispersed therein, but it is preferable that the toner has two or more color forming sections. "Color forming section" here means a continuous region which is capable of forming one specified color when an external stimulation is applied.

In a case where two or more color forming sections are contained in the toner, the color forming sections may be only one kind which can form the same color, but it is particularly preferable that two or more kinds of color forming sections which can form different colors from each other are contained in the toner. In the first case, the color that a single toner particle can form is limited to only one kind, while in the latter case, the color can be two or more kinds.

Examples of two or more kinds of color forming sections which can form different colors from each other include a combination of a yellow color forming section which can form a color of yellow, a magenta color forming section which can form a color of magenta, and a cyan color forming section which can form a color of cyan.

In this case, for example, when any one kind of color forming section forms a color by an external stimulation, the toner forms any one color of yellow, magenta or cyan. When any two kinds of color forming sections form colors, a combined color of the colors formed by these two kinds of color forming sections can be formed. That is, various colors can be exhibited by only one kind of toner particles.

The color to be formed when two or more kinds of color forming sections capable of forming different colors from each other are contained in the toner can be controlled by differentiating the wavelength of lights used for curing a photo-curable composition contained in each color forming section as well as differentiating the kind or the combination of the first component and the second component contained in respective color forming sections.

In this case, plural kinds of color forming information imparting light having different wavelengths corresponding to respective color forming sections may be used as a controlling stimulation. To differentiate the wavelength of the lights required for curing the photo-curable composition contained in respective color forming sections, it is preferable to include a photopolymerization initiator which is sensitive to the lights having different wavelengths in the photo-curable compositions contained in each color forming section.

For example, when three kinds of color forming sections which can form yellow, magenta and cyan are contained in the toner, the toner can form a desired color by using these three color forming information imparting lights (lights having a specified wavelength) having different wavelengths, when materials which are curable in response to any one of light wavelength of 405 nm, 532 nm and 657 nm are used for the photo-curable composition contained in respective kinds of color forming sections.

The wavelength of the color forming information imparting light can be selected from a wavelength in the visible region, but may be selected from a wavelength of an ultraviolet region and an infrared region as well. When a wavelength is selected from an ultraviolet region, beam diameter is easily narrowed due to the short wavelength thereof, and high-precision can be obtained. As a light source of such kind of wavelength, there are a wavelength conversion solid SHG laser (a laser which converts a base wavelength into ½) and a gas laser.

When a wavelength of color forming information imparting light is selected not from a visible region but from an infrared region, it is advantageous in that a price of a light-emitting device itself is low and high output can easily be obtained, as is conventionally known.

The toner of the invention may contain a base material containing, as a main component, the same binding resin as that used in conventional toners using a coloring agent such as a pigment. In this case, it is preferable that each of two or more color forming sections is dispersed in the form of particles in the base material, and it is particularly preferable that these color forming sections dispersed in the form of particles are previously formed as capsules by the time of preparing the toner (hereinafter, a color forming section comprising capsule-like particles is referred to as "photosensitive/thermosensitive capsules" in some cases). A releasing agent and various additives may be contained in the base material, as is the case for a conventional toner using a coloring agent such as a pigment.

The photosensitive/thermosensitive capsules comprise a core part containing microcapsules and a photo-curable composition, and an outer shell coating the core part. This outer shell is not particularly limited as long as it can be stably retained so that the microcapsules and the photo-curable composition in the photosensitive/thermosensitive capsules do not leak outside the photosensitive/thermosensitive capsules during the manufacturing process of the toner as described later, or at the time of storage.

However, in the invention, it is preferable that a material which is insoluble in water such as a binding resin and a releasing material comprising a resin which is insoluble in water is contained as a main component in order to prevent a second component from permeating through the outer shell and flow into a matrix outside the photosensitive/thermosensitive capsules, or prevent a second component contained in the photosensitive/thermosensitive capsules which can form a different color from permeating through the outer shell to flow in, and a non-water-soluble resin such as a styrene-acryl copolymer or a polyester is particularly preferably used.

When the non-water-soluble resin is used as a material which constitutes the outer shell of the photosensitive/thermosensitive capsules, and when the non-water-soluble resin is a crystallizing resin, the melting point thereof is preferably in the range of 40 to 80° C., more preferably 50 to 70° C. In addition, when the non-water-soluble resin is an amorphous resin, the glass transition temperature thereof is preferably in the range of 40 to 80° C., more preferably 50 to 70° C.

When the melting point or the glass transition temperature is below the aforementioned range, the outer shell is softened by heating during the process of preparing a toner in some cases, and when the melting point or the glass transition temperature is above the aforementioned range, the fixing temperature has to be set higher and a consumption amount of energy may increase in some cases since, since the outer shell does not get soft even if a heat treatment having both functions of application of color forming stimulation and fixation is performed, and formation of a color is difficult.

Other than the aforementioned embodiment in which a color forming section is dispersed in a base material (hereinafter, referred to as "color forming section-dispersed structure" in some cases), The embodiments of the toner of the invention preferably has a structure in which at least any one of two or more color forming sections is in contact adjacently with at least one of the other color forming sections so as to form an interface (hereinafter, a color forming section forming an interface with at least one or more of the other color forming sections is referred to as a "photosensitive/thermosensitive layer" in some cases).

Embodiments of such kind include, for example, (1) an embodiment in which a photosensitive/thermosensitive layer forms a core layer and one or more photosensitive/thermosensitive layer are sequentially laminated on the core layer to cover the core layer (hereinafter, referred to as a "concentric structure" in some cases), (2) an embodiment in which a cross-sectional plane thereof obtained when the toner is cut in a predetermined direction has a structure consisting of two or more photosensitive/thermosensitive layers being laminated in a band-like manner (hereinafter, referred to as a "stripe structure" in some cases), and (3) an embodiment in which a cross-sectional plane thereof obtained when the toner is cut in a predetermined direction is divided in a radially-segmented manner from the center of the toner, and each sector area consists of the photosensitive/thermosensitive layer (hereinafter, referred to as a "radially-segmented structure" in some cases).

In any case of a concentric structure, a stripe structure and a radially-segmented structure, it is particularly preferable that an intermediate layer containing a material constituting an outer shell of the aforementioned photosensitive/thermosensitive capsules is provided between the two photosensitive/thermosensitive layers which are adjacently in contact with each other to form an interface. In addition, the intermediate layer may contain a releasing agent and various additives as is the case for conventional toners using a coloring agent such as a pigment. It is also preferable that a coating layer containing a binding resin is provided on the outermost surface of these three kinds of toners.

Figure 2:
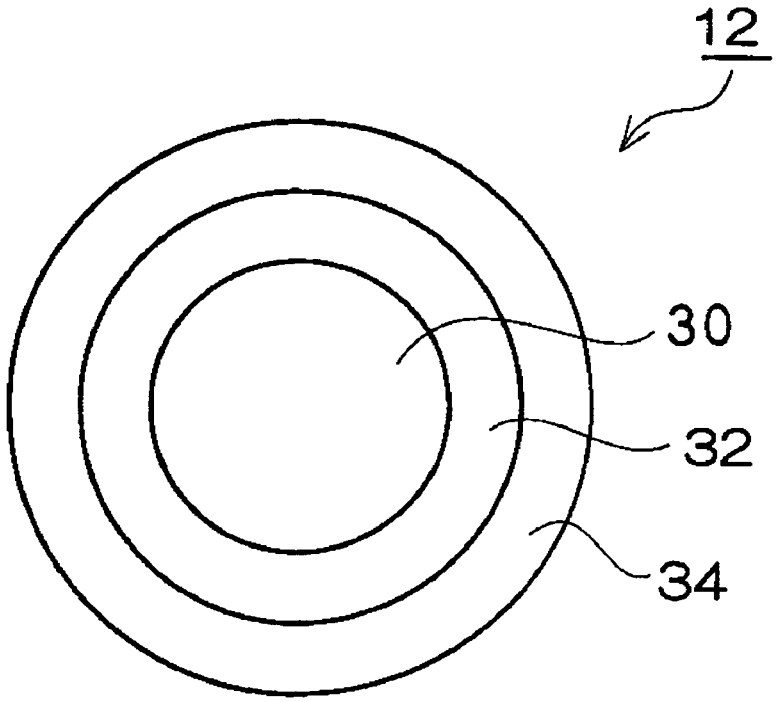
FIG. 2 is a schematic sectional view illustrating an example of the toner of the invention having a concentric structure.
Figure 3:
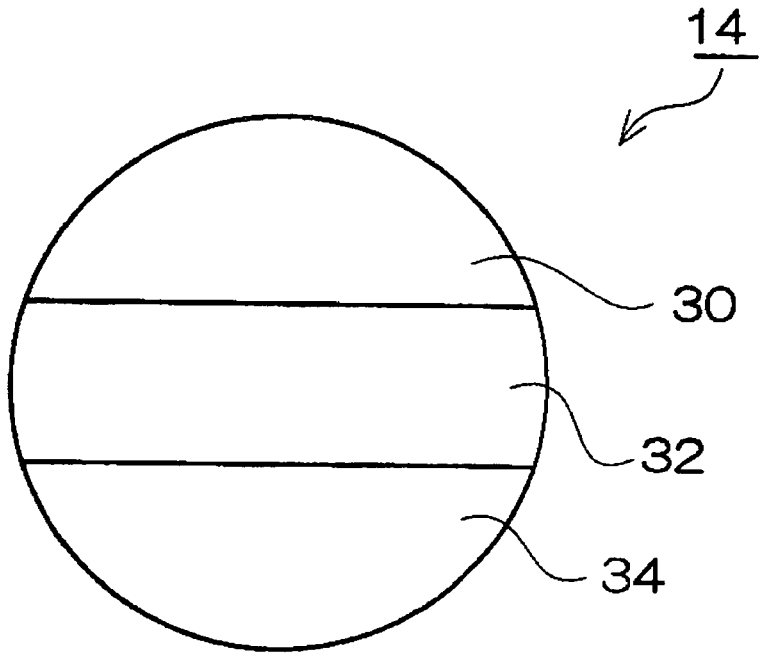
FIG. 3 is a schematic sectional view illustrating an example of the toner of the invention having a stripe structure.
Figure 4:
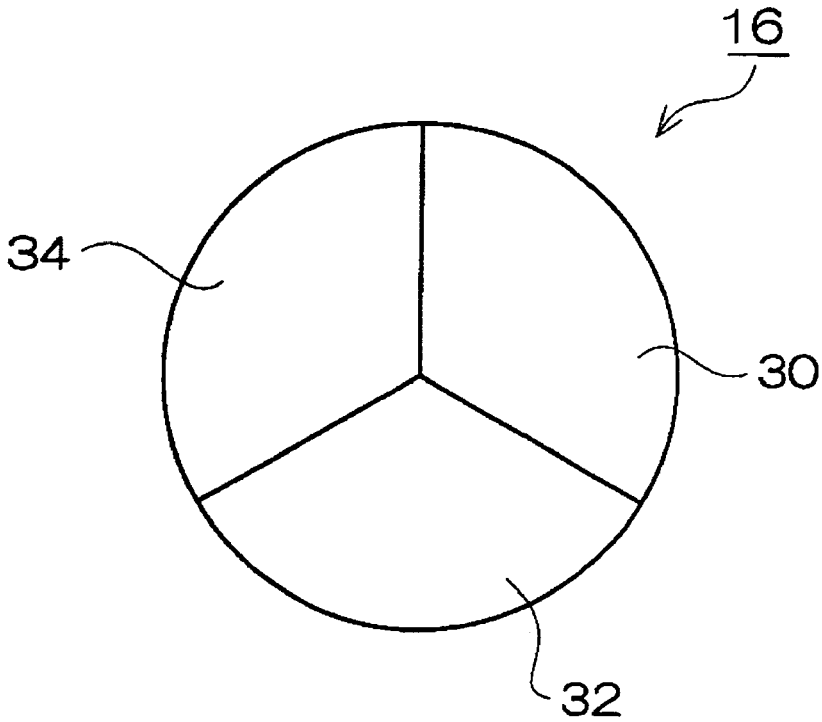
FIG. 4 is a schematic sectional view illustrating an example of the toner of the invention having a radially-segmented structure.

FIG. 1 is a schematic cross-sectional view showing one example of the cases where the toner of the invention comprises a base material and a color forming section dispersed in the base material in the form of particles, FIG. 2 is a schematic cross-sectional view showing one example of the cases where the structure of the toner is a concentric structure, FIG. 3 is a schematic cross-sectional view showing one example of the cases where the structure of the toner is a stripe structure, and FIG. 4 is a schematic cross-sectional view showing one example of the cases where a structure of the toner of the invention is a sector structure.

In FIG. 1 to FIGS. 4, 10, 12, 14 and 16 represent a toner, 20 represents a first color forming section, 22 represents a second color forming section, 24 represents a third color forming section, 26 represents a base material, 30 represents a first photosensitive/thermosensitive layer, 32 is a second photosensitive/thermosensitive layer, and 34 represents a third photosensitive/thermosensitive layer. FIG. 1 to FIG. 4 show only a main part of a toner, and descriptions of an intermediate layer provided between the adjacent two photosensitive/thermosensitive layers, a coating layer provided on the outermost surface of the toner or the like are omitted.

In a toner 10 shown in FIG. 1, three kinds of color forming sections 20, 22 and 24 are dispersed in a base material 26, which are respectively capable of forming colors of, for example, yellow, magenta and cyan. For convenience of explanation, FIG. 1 shows only one color forming section for each kind, but it is preferable that two or more color forming sections for each kind are contained.

A toner 12 shown in FIG. 2 comprises a first photosensitive/thermosensitive layer 30 which forms a core layer, and a second photosensitive/thermosensitive layer 32 and a third photosensitive/thermosensitive layer 34 which are sequentially laminated on the first photosensitive/thermosensitive layer 30 forming the core layer.

A toner 14 shown in FIG. 3 comprises a second photosensitive/thermosensitive layer 32 in a band-like form, and a first photosensitive/thermosensitive layer 30 and a third photosensitive/thermosensitive layer 34, both in a band-like form, which are disposed on both sides of the second photosensitive/thermosensitive layer 32.

A toner 16 shown in FIG. 4 has a structure in which each of three regions divided in a radially-segmented manner from the center of the toner 16, and each of which corresponds to each of the three photosensitive/thermosensitive layers 30, 32 and 34.

In the toners 12, 14 and 16 shown in FIG. 2 to FIG. 4, the three photosensitive/thermosensitive layers 30, 32 and 34 are respectively capable of forming colors of, for example, yellow, magenta and cyan.

A toner having a structure in which color forming sections are dispersed in a base material or a concentric structure can be prepared, for example, by utilizing an emulsion aggregation method which is described later, and a toner having a concentric structure, stripe structure or a sector structure can be prepared utilizing a wet method using a microreactor.

-Constituent Materials for the Toner-

Constituent materials for a toner which are used when the toner of the invention is a photo-developable toner, materials and methods used for preparation of each constituting material will now be described.

When the toner of the invention is a photo-developable toner, at least a first component, a second component, microcapsules containing a first component, and a photo-curable composition containing a second component and a photopolymerizable compound are used. It is particularly preferable that a photopolymerization initiator (or a photopolymerization initiator-based material) is contained in the photo-curable composition, and a spectroscopic sensitizing pigment or various aids may also be contained. The first component may be present in the microcapsules (a core part) in the solid state, or in combination with a solvent.

In the case of the photo-developable toner, an electron donating colorless dye is used as a first component, and an electron accepting compound (referred to as "electron accepting developer" or "developer" in some cases) is used as a second component, and a polymerizable compound having an ethylenically unsaturated bond is used as a photopolymerizable compound, in the case of a first photo-developable toner.

In addition to the above-listed materials, various materials such as binding resins, releasing agents, internal additives and external additives, which are the same as the materials constituting conventional toners using a coloring agent, can further be utilized, if appropriate.

-Polymerizable Compounds Having an Ethylenically Unsaturated Bond (Photopolymerizable Compounds)-

In the invention, a polymerizable compound having at least one ethylenically unsaturated double bond in a molecule can be used.

For example, compounds can be used, such as an acrylic acid and a salt thereof, acrylic acid esters, acrylamides, methacrylic acid and a salt thereof, methacrylic acid esters, methacrylamides, maleic anhydride, maleic acid esters, itaconic acid, itaconic acid esters, styrenes, vinyl ethers, vinyl esters, N-vinyl heterocycles, allyl ethers and allyl esters, and preferably used a polymerizable compound containing a heteroatom having at least one lone electron pair in a molecule.

The term a heteroatom having a lone electron pair here denotes the atoms such as oxygen, nitrogen, sulfur, phosphorus and halogen, specifically includes the ones having ester bond, amide bond, carbonyl bond, thiocarbonyl bond, ether bond and thioether bond, and a group such as amine, alcohol, thioalcohol, phosphine and halogen. Among them, a polymerizable compound having an ethylenically unsaturated bond which has at least one of ester bond, amide bond, amine, carbonyl bond and/or ether bond, which have a strong interaction property with an electron accepting developer, in a molecule, is preferable, and a compound having an ester bond or amide bond having photopolymerizability is particularly preferable.

In addition, to facilitate polymerization efficacy (curing rate), a polymerizable compound having a plurality of ethylenically unsaturated double bonds in a molecule is preferable, and examples thereof include acrylic acid ester or methacrylic acid ester of polyhydric alcohols such as trimethylolpropane and pentaerythritol, acrylate or methacrylate-terminal epoxy resin, and acrylate or methacrylate-terminal polyester.

Examples of a particularly preferable compound include ethylene glycol diacrylate, ethylene glycol diemethacrylate, trimethylolpropane triacrylate, pentaerythritol tetraacrylate, dipentaerythritol hydroxypentaacrylate, hexanediol-1,6-dimethacrylate and diethylene glycol dimethacrylate. As regards a molecular weight of these polymerizable compounds, the ones having the molecular weight of about 100 to about 5,000 can be used, but particularly preferably a compound which hardly thermally diffuse into the microcapsules containing the electron donating colorless dye, and a compound having a molecular weight of 200 or more is particularly useful.

-Photopolymerization Initiator (or Photopolymerization Initiator-Based Materials)-

As a photopolymerization initiator suitably used in the invention, one or a combination of two or more kinds of compounds can be selected from compounds which can initiate photopolymerization of the aforementioned compounds containing an ethylenically unsaturated bond.

Preferable examples of the photopolymerization initiator are the following compounds. Known photopolymerization initiators in the field of a photosensitive/thermosensitive recording material such as aromatic ketones, e.g. benzophenone, 4,4'-bis(dimethylamino)benzophenone, 4-methoxy-4'-dimethylaminobenzophenone, 4,4'-dimethoxybenzophenone, 4-dimethylaminobenzophenone, 4-dimethylaminoacetophenone, benzil, anthraquinone, 2-tert-butylanthraquinone, 2-methylanthraquinone, xanthone, thioxanthone, 2-chlorothioxanthone, 2,4-diethylthioxanthone, fluorenone, acridone; benzoin and benzoin ethers, e.g. benzoin methyl ether, benzoin ethyl ether, benzoin isopropyl ether, benzoin phenyl ether; 2,4,5-triarylimidazole dimmer, e.g. 2-(o-chlorophenyl)-4,5-diphenylimidazole dimer, 2-(o-chlorophenyl)-4,5-di(m-methoxyphenyl)imidazole dimer, 2-(o-fluorophenyl)-4,5-diphenylimidazole dimer, 2-(o-methoxyphenyl)-4,5-diphenylimidazole dimer, 2-(p-methoxyphenyl)-4,5-diphenylimidazole dimer; polyhalogen compounds, e.g. carbon tetrabromide, phenyltribromomethylsulfone, phenyl trichloromethyl ketone and compounds described in the specifications of Japanese Patent Application Laid-Open (JP-A) No. 53-133428, Japanese Patent Application Publication (JP-B) No. 57-1819, JP-B No. 57-6096, U.S. Pat. No. 3,615,455, S-triazine derivatives having a trihalogen-substituted methyl group described in JP-A No. 58-29803, e.g. compounds such as 2,4,6-tris(trichloromethyl)-S-triazine, 2-methoxy-4,6-bis(trichloromethyl)-S-triazine, 2-amino-4,6-bis(trichloromethyl)-S-triazine, 2-(P-methoxystyryl)-4,6-bis(trichloromethyl)-S-triazine; organic peroxides described, for example, in JP-A No. 59-189340, e.g. compounds such as methyl ethyl ketone peroxide, cyclohexanone peroxide, 3,3,5-trimethylcyclohexanone peroxide, benzoyl peroxide, ditertiary butyl diperoxyisophthalate, 2,5-dimethyl-2,5-di(benzoylperoxy)hexane, tertiary butyl peroxybenzoate, a,a'-bis(tertiary butyl peroxyisopropyl)benzene, dicumyl peroxide, 3,3',4,4'-tetra-(tertiary isobutyl peroxycarbonyl)benzophenone; azinium salt compounds described, for example, in U.S. Pat. No. 4,743,530; organic boron compounds described, for example, in EP 0223587, e.g. triphenylbutyl borate tetramethylammonium salt, triphenyl butyl borate tetrabutylammonium salt, and tri(p-methoxyphenyl)butylborate tetramethylammonium salt; and diaryl iodonium salts and iron allene complexes can be usefully used.

Combinations of two or more kinds of compounds which are known as a photopolymerization initiator-based material can also be used in the invention.

Examples of a combination of two or more kinds of compounds include a combination of 2,4,5-triarylimidazole dimer and mercaptobenzoxazole, a combination of 4,4'-bis(dimethylamino)benzophenone and benzophenone or benzoin methyl ether described in U.S. Pat. No. 3,427,161, a combination of benzoyl-N-methylnaphthothiazolin and 2,4-bis(trichloromethyl)-6-(4'-methoxyphenyl)-triazole described in U.S. Pat. No. 4,239,850, a combination of dialkylaminobenzoic acid ester and dimethylthioxanthone described in JP-A No. 57-23602, and a combination of three kinds of 4,4'-bis(dimethylamino)benzophenone, benzophenone, polyhalogenated methyl compound of JP-A No. 59-78339.

More preferable examples include a 2,4,5-triarylimidazole dimer, and an organic boron compound.

Content of the photopolymerization initiator is preferably 0.01 to 20% by mass, more preferably 0.2 to 15% by mass and most preferably 1 to 10% by mass based on the total weight of the photo-curable composition. When the content is less than 0.01% by mass, sensitivity may be deficient, and when exceeds 10% by mass, increase in sensitivity cannot be expected too, in some cases.

-Spectroscopic Sensitizer Pigment-

The photo-curable composition may contain, in addition to the polymerizable compound having an ethylenically unsaturated bond and the photopolymerization initiator, spectroscopic sensitizer pigments for adjusting the photosensitive wavelength thereof.

As the spectroscopic sensitizer pigment, various compounds which are known in the field of a photosensitive/thermosensitive recording material can be used.

As examples of the spectroscopic sensitizer pigment, the aforementioned patents concerning the photopolymerization initiator, Research Disclosure, Vol. 200, 1980, December, Item 20036, "Sensitizer" (edited by Katsumi Tokumaru•Shin Ogawara, Kodansha Ltd., 1987, pp. 160-163) can be referenced. As specific examples of the spectroscopic sensitizer pigment, for example, JP-A No. 58-15503 discloses a 3-ketocoumarin compound, JP-A No. 58-40302 discloses thiopyrilium salt, JP-B Nos. 59-28328 and 60-53300 disclose a naphthothiazolemerocyanine compound, JP-B Nos. 61-9621 and 62-3842, and JP-A Nos. 59-89303 and 60-60104 disclose a merocyanine compound. By using these spectroscopic sensitizers, spectroscopic sensitivity of a photopolymerization initiator can be extended up to a visible region. In the aforementioned examples, trihalomethyl-S-triazine compound is mentioned as the photopolymerization initiator, which also can be combined with other photopolymerization initiators.

Examples of the spectroscopic sensitizing pigment include keto pigments such as coumarin (including ketocoumarin or sulfonocoumarin) pigments, merostyryl pigments, oxonole pigments and hemioxonole pigments; non-keto polymethine pigments such as non-ketopolymethine pigments, anthracene pigment, rhodamin pigments, acridine pigments, aniline pigments and azo pigments, and cyanine and hemicyanine and styryl pigments which are non-keto polymethine pigments -Aids- In the photo-curable composition, a reducing agent, e.g. an oxygen scavenger and a chain transfer agent of an active hydrogen donor, and other compounds which promote polymerization in a chain transferring manner can also be used as an aid for further promoting the polymerization.

Oxygen scavengers which are found to be useful include phosphine, phosphonate, phosphite, stannous salts and other compounds which are easily oxidized with oxygen. Examples thereof include N-phenylglycine, trimethylbarbituric acid, N,N-dimethyl-2,6-diisopropylaniline and N,N,N-2,4,6-pentamethylaniline. Furthermore, thiols, thioketones, trihalomethyl compounds, lophine dimer compounds, iodonium salts, sulfonium salts, azinium salts and organic peroxides described below are also useful as a polymerization promoter.

In addition to these compounds, a thermal polymerization inhibitor can further be added to a photo-curable composition, if necessary. The thermal polymerization inhibitor is added for the purpose of preventing thermal polymerization or polymerization with time of a photo-curable composition, which can enhance chemical stability of a photo-curable composition at the time of preparation or storage. Examples of the thermal polymerization inhibitor include t-methoxyphenol, hydroquinone, t-butylcatechol, pyrogallol, 2-hydroxybenzophenone, 4-methoxy-2-hydroxybenzophenone, cuprous chloride, phenothiazine, chloranil, naphthylamine, β-naphthol, 2,6-di-t-butyl-p-cresol, nitrobenzene, dinitrobenzene, picric acid, and p-toluidine. Preferable amount of the thermal polymerization inhibitor to add is 0.001 to 5% by mass, more preferably 0.01 to 1% by mass based on the total weight of a photo-curable composition. When the content of the thermal polymerization inhibitor is less than 0.001% by mass, thermal stability may be inferior, and when exceeds 5% by mass, sensitivity may be lowered.

The photo-curable composition may optionally be used in the manner of being enclosed in microcapsules. The photo-curable composition can be encapsulated in microcapsules, for example, in accordance with EP No. 0223587 and the aforementioned patents.

-Electron Accepting Developer (the Second Component)-

Examples of an electron accepting developer include phenol derivatives, sulfur-containing phenol derivatives, organic carboxylic acid derivatives, e.g. salicylic acid, stearic acid, resorcylic acid, and metal salts thereof, sulfonic acid derivatives, urea or thiourea derivatives, acid clay, bentonite, novolak resin, metal-treated novolak resin, and metal complexes.

These examples are described in "Paper Pulp Technique Times", 1985, pp. 49-54 and pp. 65-70, JP-B Nos. 40-9309 and 45-14039, JP-A Nos. 52-140438, 48-51510, 57-210886, 58-87089, 59-11286, 60-176795 and 61-95988.

Examples thereof include, as a phenolic compound, 2,2'-bis(4-hydroxyphenyl)propane, 4-t-butylphenol, 4-phenylphenol, 4-hydroxydiphenoxide, 1,1'-bis(3-chloro-4-hydroxyphenyl)cyclohexane, 1,1'-bis(4-hydroxyphenyl) cyclohexane, 1,1'-bis(3-chloro-4-hydroxyphenyl)-2-ethylbutane, 4,4'-sec-isooctylidinediphenol, 4,4'-sec-butylidenediphenol, 4-tert-octylphenol, 4-p-methylphenylphenol, 4,4'-methylcyclohexylidinephenol, 4,4'-isopentylidinephenol, and benzyl p-hydroxybenzoate.

As a salicylic acid derivative, 4-pentadecylsalicylic acid, 3,5-di(α-methylbenzyl)salicylic acid, 3,5-di(tert-octyl)salicylic acid, 5-octadecylsalicylic acid, 5-α-(p-α-methylbenzylphenyl)ethylsalicylic acid, 3-α-methylbenzyl-5-tert-octylsalicylic acid, 5-tetradecylsalicylic acid, 4-hexyloxysalicylic acid, 4-cyclohexyloxysalicylic acid, 4-decyloxysalicylic acid, 4-dodecyloxysalicylic acid, 4-pentadecyloxysalicylic acid, 4-octadecyloxysalicylic acid, and zinc, aluminum, calcium, copper and lead salts thereof.

These electron-accepting compounds can be used alone or in combination of two or more kinds thereof. The amount of the electron-accepting compound to be used is preferably in the range of 10 to 4000% by mass, particularly preferably 100 to 2000% by mass with respect to an electron donating colorless dye.

-Electron Donating Colorless Dye (the First Component)-

As an electron donating colorless dye, known compounds such as triphenylmethanephthalide-based compounds, fluoran-based compounds, phenothiazine-based compounds, indolylphthalide-based compounds, leucoauramine-based compounds, rhodaminelactam-based compounds, triphenylmethane-based compounds, triazene-based compounds, spiropyran-based compounds, and fluorene-based compounds can be used.

Examples of phthalides are described in U.S. Pat. Reissued No. 23,024, U.S. Pat. Nos. 3,491,111, 3,491,112, 3,491,116, 3,509,174 and the like. Examples of fluoranes are described in U.S. Pat. Nos. 3,624,107, 3,627,787, 3,641,011, 3,462,828, 3,681,390, 3,920,510, 3,959,571 and the like. Examples of spirodipyrans are described in U.S. Pat. No. 3,971,808 and the like. Examples of pyridine-based and pyrazine-based compounds are described in U.S. Pat. Nos. 3,775,424, 3,853,869, 4,246,318 and the like. Examples of the fluorene-based compounds are described in Japanese Patent Application No. 61-240989 and the like.

Part of the examples include, as the triarylmethane-based compounds, 3,3-bis(p-dimethylaminophenyl)-6-dimethylaminophthalide, 3,3-bis(p-dimethylaminophenyl)phthalide, 3-(p-dimethylaminophenyl)-3-(1,3-dimethylindol-3-yl)phthalide, and 3-(p-dimethylaminophenyl)-3-(2-methylindol-3-yl)phthalide. As the diphenylmethane-based compounds, there are included 4,4'-bis-dimethylaminobenzhydrinbenzyl ether, N-halophenyl-leucoauramine, and N-2,4,5-trichlorophenylleucoauramine. As the xanthene-based compound, there are included rhodamine-B-anilinolactam, rhodamine-(p-nitrino)lactam, 2-(dibenzylamino)fluoran, 2-anilino-3-methyl-6-diethylaminofluoran, 2-anilino-3-methyl-6-dibutylaminofluoran, 2-anilino-3-methyl-6-N-ethyl-N-isoamylaminofluoran, 2-anilino-3-methyl-6-N-methyl-N-cyclohexylaminofluoran, 2-anilino-3-chloro-6-diethylaminofluoran, 2-anilino-3-methyl-6-N-ethyl-N-isobutylaminofluoran, 2-anilino-6-dibutylaminofluoran, 2-anilino-3-methyl-6-N-methyl-N-tetrahydrofurfurylaminofluoran, 2-anilino-3-methyl-6-piperidinoaminofluoran, 2-(o-chloroanilino)-6-diethylaminofluoran, and 2-(3,4-dichloroanilino)-6-diethylaminofluoran. Examples of the thiazine-based compounds, there are included banzoylleucomethylene blue and p-nitrobenzylleucomethylene blue. Examples of the spiro-based compounds, there are included 3-methyl-spiro-dinaphthopyran, 3-ethyl-spiro-dinaphthopyran, 3,3'-dichloro-spiro-dinaphthopyran, 3-benzylspiro-dinaphthopyran, 3-methyl-naphtho-(3-methoxy-benzo)-spiropyran, and 3-propyl-spiro-dibenzopyran.

In particular, when used in a full color recording material, U.S. Pat. No. 4,800,149 can be referenced for an electron donating colorless dye for cyan, magenta or yellow, U.S. Pat. No. 4,800,148 can be referenced for a type of forming yellow, and JP-A No. 63-53542 can be referenced for a type of forming cyan.

-Microcapsules and Microcapsulation-

In microcapsulating an electron donating colorless dye, microcapsules can be prepared by known methods in the field of a photosensitive/thermosensitive recording material.

For example, there are methods utilizing coacervation of a hydrophilic wall forming material described in U.S. Pat. Nos. 2,800,457 and 2,800,458, interface polymerization methods described in U.S. Pat. No. 3,287,154, British Patent No. 990443, JP-B Nos. 38-19574, 42-446 and 42-771, methods utilizing precipitation of a polymer described in U.S. Pat. Nos. 3,418,250 and 3,660,304, a method using an isocyanate polyol wall material described in U.S. Pat. No. 3,796,669, a method using an isocyanate wall material described in U.S. Pat. No. 3,914,511, methods using a urea-formaldehyde-based, or a urea formaldehyde-resorcinol-based wall forming material described in U.S. Pat. Nos. 4,001,140, 4,087,376 and 4,089,802, a method using a wall forming material such as a melamine-formaldehyde resin or hydroxypropylcellulose described in U.S. Pat. No. 4,020,455, an in situ method utilizing polymerization of a monomer described in JP-B No. 36-9168 and JP-A No. 51-9079, electrolysis dispersion cooling methods described in British Patent Nos. 952807 and 965074, and spray drying methods described in U.S. Pat. No. 3,111,407 and British Patent No. 930422. The methods are not limited to the aforementioned examples, but are preferably the ones in which a polymer membrane is formed as a microcapsule wall (outer shell) after a substance to be the core part of microcapsules is emulsified.

As a method of producing a microcapsule wall, in particular, a microcapsulation method utilizing polymerization of a reactant from the interior of an oil droplet is used to obtain a capsule which is preferable as a toner having a uniform particle diameter and an excellent bio-storability in a short time.

When using polyurethane as a microcapsule wall material, polyvalent isocyanate and, if necessary, a second substance (e.g. polyol and polyamine) which forms a microcapsule wall when reacted with the microcapsule wall material is mixed into an oily liquid to be microcapsulated, then emulsified and dispersed in water, and the temperature is increased to cause a polymer forming reaction at an oil droplet interface, thereby a microcapsule wall is formed. In this case, an assistant solvent having a low boiling point and a strong dissolving force can be used in the oily liquid. As the polyvalent isocyanate and the polyol or polyamine which react therewith, to be used here, there are disclosed the ones in U.S. Pat. Nos. 3,281,383, 3,773,695 and 3,793,268, JP-B Nos. 48-40347 and 49-24159, and JP-A Nos. 48-80191 and 48-84086.

Examples of the polyvalent isocyanate include diisocyanates such as m-phenylene diisocyanate, p-phenylene diisocyanate, 2,6-tolylene diisocyanate, 2,4-tolylene diisocyanate, naphthalene-1,4-diisocyanate, diphenylmethane-4,4'-diisocyanate, 3,3'-dimethoxy-4,4'-biphenyl-diisocyanate, 3,3'-dimethyldiphenylmethane-4,4'-diisocyanate, xylylene-1,4-diisocyanate, 4,4'-diphenylpropane diisocyanate, trimethylene diisocyanate, hexamethylene diisocyanate, propylene-1,2-diisocyanate, butylene-1,2-diisocyanate, cyclohexylene-1,2-diisocyanate and cyclohexylene-1,4-diisocyanate; triisocyanates such as 4,4',4"-triphenylmethane triisocyanate and toluene-2,4,6-triisocyanate; tetraisocyanates such as 4,4'-dimethyldiphenylmethane-2,2' and 5,5'-tetraisocyanate; isocyanate prepolymers such as an adduct of hexamethylene diisocyanate and trimethylolpropane, an adduct of 2,4-tolylene diisocyanate and trimethylolpropane, an adduct of xylylene diisocyanate and trimethylolpropane, and an adduct of tolylene diisocyanate and hexanetriol.

Examples of the polyol include aliphatic or aromatic polyhydric alcohols, hydroxyl polyester and hydroxyl polyalkylene ether. Polyols described in JP-A No. 60-49991 such as ethylene glycol, 1,3-propanediol, 1,4-butanediol, 1,5-pentanediol, 1,6-hexanediol, 1,7-heptanediol, 1,8-octanediol, propylene glycol, 2,3-dihydroxybutane, 1,2-dihydroxybutane, 1,3-dihydroxybutane, 2,2-dimethyl-1,3-propanediol, 2,4-pentanediol, 2,5-hexanediol, 3-methyl-1,5-pentanediol, 1,4-cyclohexanedimethanol, dihydroxycyclohexane, diethylene glycol, 1,2,6-trihydroxyhexane, 2-phenylpropylene glycol, 1,1,1-trimethylolpropane, hexanetriol, pentaerythritol, pentaerythritol ethylene oxide adduct, glycerin ethylene oxide adduct, glycerin, 1,4-di(2-hydroxyethoxy)benzene, condensed products of an aromatic polyhydric alcohol and alkylene oxide such as resorcinol dihydroxyethyl ether, p-xylylene glycol, m-xylylene glycol, α,α'-dihydroxy-p-diisopropylbenzene, 4,4'-dihydroxy-diphenylmethane, 2-(p-p'-dihydroxydiphenylmethyl)benzyl alcohol, an adduct of bisphenol A and ethylene oxide, and an adduct of bisphenol A and propylene oxide can also be used.

It is preferable that the polyol is used at a molar ratio of 0.02 to 2 of a hydroxyl group to 1 of an isocyanate group.

Examples of the polyamine include ethylenediamine, trimethylenediamine, tetramethylenediamine, pentamethylenediamine, hexamethylenediamine, p-phenylenediamine, m-phenylenediamine, piperazine, 2-methylpiperaizine, 2,5-dimethylpiperazine, 2-hydroxytrimethylenediamine, diethylene, triamine, triethylenetriamine, triethylenetetramine, diethylaminopropylamine, tetraethylenepentamine, and an amine adduct of an epoxy compound. Polyvalent isocyanate can also form a high-molecular substance when reacted with water.

When microcapsules are produced, a water-soluble polymer can be used, which may be water-soluble anionic polymer, nonionic polymer or amphoteric polymer. As the anionic polymer, either a natural or a synthetic polymer can be used, and examples thereof include polymers having a group such as —COO— and —$SO_2$—. Specific examples of the anionic natural polymer include gum arabic, alginic acid and pectin, and examples of the hemi-synthetic product include carboxymethylcellulose, phthalated gelatin, starch sulfate, cellulose sulfate and ligninsulfonic acid. Examples of the synthetic product include a maleic anhydride-based (including that obtained by hydrolysis) copolymer, an acrylic acid-based (including methacrylic acid-based) polymer and copolymer, a vinylbenzenesulfonic acid-based polymer and copolymer, and carboxy-modified polyvinyl alcohol.

Examples of the nonionic polymer include polyvinyl alcohol, hydroxyethylcellulose, and methylcellulose. Examples of the amphoteric compound include gelatin. These water-soluble polymers are used as an aqueous solution in which 0.01 to 10% by mass thereof is contained.

It is preferable that a volume average particle diameter of the microcapsules is adjusted in the range of 0.1 to 3 μm, and it is further preferable to adjust in the range of 0.3 to 1.0 μm. When the volume average particle diameter of the microcapsules is less than 0.1 μm, a color concentration becomes relatively problematic in some cases due to the thickness of an outer shell. When the volume average particle diameter exceeds 3.0 μm, dispersing into a toner particle becomes nonuniform, and color formation becomes uneven in some cases.

As a material which constitutes an outer shell of microcapsules, the aforementioned thermoplastic resins such as urethane can be utilized. As these thermoplastic resin materials, known amorphous resins or crystalline resins can be utilized.

When the amorphous resin is used, a glass transition temperature thereof is preferably in the range of 90 to 200° C., more preferably in the range of 100 to 150° C. When the glass transition temperature is less than 90° C., the outer shell is softened by heating during toner preparation process in some cases, and when the glass transition temperature is more than 200° C., color formation becomes difficult because the outer shell is not softened even when a heating treatment aimed at both stimulating the formation of a color and fixing is performed at the time of image formation, or the amount of energy to be consumed becomes large because the temperature for fixation must be set higher, in some cases.

When the crystalline resin is used, a melting point thereof is preferably in the range of 90 to 200° C., more preferably in the range of 100 to 150° C. When the melting point is outside the aforementioned range, the same problems as that of the case where the amorphous resin is used occurs in some cases.

-Solvents (Used in Microcapsules)-

An electron donating colorless dye may be present in the form of a solution or a solid in microcapsules. When a solvent is used together, the amount of thereof to be used in a capsule is preferably in a ratio of 1 to 500 parts by mass with respect to 100 parts by mass of an electron donating colorless dye.

As the solvent used in the invention, a natural oil or a synthetic oil can be used together. Examples thereof include cottonseed oil, kerosene, aliphatic ketone, aliphatic ester, paraffin, naphthene oil, alkylated diphenyl, alkylated terphenyl, chlorinated paraffin, alkylated naphthalene, diarylethane such as 1-phenyl 1-xylylethane, 1-phenyl 1-p-ethylphenylethane, and 1,1'-ditolylethane, phthalic acid alkyl ester (e.g. dibutylphthalate, dioctylphthalate, dicyclohexyl phthalate), phosphoric acid ester (e.g. diphenyl phosphate, triphenyl phosphate, tricresyl phosphate, dioctylbutyl phosphate), citric acid ester (e.g. tributyl acetyl citrate), benzoic acid ester (e.g. octyl benzoate), alkylamide (e.g. diethyllaurylamide), fatty acid esters (e.g. dibutoxyethyl succinate, dioctyl acetate), trimesic acid esters (e.g. tributyl trimesate), lower alkyl acetate such as ethyl acetate and butyl acetate, ethyl propionate, secondary butyl alcohol, methyl isobutyl ketone, β-ethoxyethyl acetate, methylcellosolve acetate, and cyclohexanone. In addition, at the time of microcapsulation, a volatile solvent may also be used together as an assistant solvent for dissolving the electron donating colorless dye. Examples of this kind of solvent include ethyl acetate, butyl acetate, and methylene chloride.

-Ultraviolet Absorbing Agents-

An ultraviolet absorbing agent can be used in the toner of the invention, if necessary, for the purpose of improving light resistance of an image. The ultraviolet absorbing agent can be added, for example, to a material constituting an outer shell of a color forming section in the case of the toner having a structure in which a color forming section is dispersed in a base material, as exemplified in FIG. 1, or can be added to a coating layer which covers the outermost surface of the toner or an intermediate layer provided between the two color forming sections which are adjacent to each other in the case of the toner having two or more layered color forming sections such as a concentric structure, a stripe structure, or a radially-segmented structure, as exemplified in FIG. 2 to FIG. 4, but can also be added to the other parts (e.g. color forming section), if necessary. As the ultraviolet absorbing agent, compounds known in the art such as benzotriazole-based compounds, cinnamic acid ester-based compounds, aminoallylidenemalonnitrile-based compounds, and banzophenone-based compounds can be used.

-Water-Soluble Polymers-

In the invention, dispersing of a photo-curable composition, dispersing of an electron donating colorless dye and capsulation are preferably performed in a water-soluble polymer, The water-soluble polymer which can preferably be used in the invention is a compound which is dissolved in water at a temperature of 25° C. by 5% by mass or more, and specific examples thereof include proteins such as gelatin, gelatin derivatives, albumin and casein, cellulose derivatives such as methylcellulose and carboxymethylcellulose, sugar derivatives such as sodium alginate and starches (including modified starches), gum arabic, synthetic polymers such as polyvinyl alcohol, styrene-maleic anhydride copolymer hydrolysate, carboxy-modified polyvinyl alcohol, polyacrylamide, saponified vinyl acetate-polyacrylic acid copolymer, and polystyrenesulfonic acid salt. Among them, gelatin and polyvinyl alcohol are preferable.

-Binders-

In the toner of the invention having structures as exemplified in FIG. 1 to FIG. 4, a binder may be contained in the color forming section. As the binder, the aforementioned water-soluble polymers, and polystyrene, polyvinyl formal, polyvinyl butyral, acryl resins e.g. polymethyl acrylate, polybutyl acrylate, polymethyl methacrylate, polybutyl methacrylate and a copolymer thereof, solvent-soluble polymers such as a phenol resin, a styrene-butadiene resin, ethylcellulose, an epoxy resin, and a urethane resin, or polymer latexes thereof, can be used. Binder resins described later may also be used as the binder.

-Surfactants-

In the toner of the invention having structures as exemplified in FIG. 1 to FIG. 4, various surfactants may be used in the color forming section for various purposes such as emulsification and dispersing.

As the surfactant, for example, nonionic surfactants such as saponin, anionic surfactants such as polyethylene oxide, polyethylene oxide derivatives such as polyethylene oxide alkyl ether, alkylsulfonate, alkylbenzenesulfonate, alkylnaphthalenesulfonate, alkyl sulfonate ester, N-acyl-N-alkyltaurines, sulfosuccinic acid esters, and sulfoalkylpolyoxyethylenealkyl phenyl ethers, amphoteric surfactants such as alkylbetaines and alkylsulfobetaines, and cationic surfactants such as aliphatic or aromatic quaternary ammonium salts can be used, if necessary.

-Solvents (Microcapsule Dispersions, Photo-Curable Composition Dispersions)-

When the toner of the invention is prepared by wet methods such as an emulsion aggregation method described later, a dispersion in which microcapsules are dispersed or a dispersion in which a photo-curable composition is dispersed is prepared. Examples of a solvent used in preparation of these dispersions include water, alcohols such as methanol, ethanol, n-propanol, isopropanol, n-butanol, sec-butanol, methylcellosolve and 1-methoxy-2-propanol; halogen-based solvents such as methylene chloride, ethylene chloride, ketones such as acetone, cyclohexanone and methyl ethyl ketone; esters such as methyl acetate cellosolve, ethyl acetate, methyl acetate; toluene, xylene and the like being used alone, or in combination of two or more kinds thereof. Among them, water is particularly preferable.

-Binding Resins-

In the toner of the invention, a binding resin used in the conventional toners can be used. The binding resin, for example, can be used, but not limited thereto, as a main component constituting a base material or a material constituting an outer shell of photosensitive/thermosensitive capsules, in the toner having a structure in which a color forming section in the form of particles is dispersed in a base material as exemplified in FIG. 1, or can be used, but not limited thereto, as a coating layer which covers the outermost surface of the toner, or a material constituting an intermediate layer provided between the two color forming sections which are adjacent to each other, in the toner having a structure such as a concentric structure, a stripe structure, and a radially-segmented structure as exemplified in FIG. 2 to FIG. 4.

The binding resin is not particularly limited, but known crystalline or amorphous resin materials can be used. In particular, a crystalline polyester resin having a sharp melt property is useful from the viewpoint of imparting low-temperature fixability.

In the invention, the "crystalline polyester resin" denotes a resin having not a process-like change in the endothermic amount but a clear endothermic peak which is observed in differential scanning calorimetry (DSC). A copolymer in which other component is copolymerized in the main chain of the crystalline polyester and the content of the other component is 50% by mass or less is also called a crystalline polyester resin.

The crystalline polyester resins, and all of the other polyester resins, are synthesized from a polyvalent carboxylic acid component and a polyhydric alcohol component. In the invention, the aforementioned polyester resin may be the one commercially available or the one suitably synthesized.

Examples of the polyvalent carboxylic acid component include aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid and 1,18-octadecanedicarboxylic acid; aromatic dicarboxylic acids such as dibasic acids of phthalic acid, isophthalic acid, terephthalic acid, naphthalene-2,6-dicarboxylic acid, malonic acid and mesaconic acid. Furthermore, anhydrides thereof and lower alkyl esters thereof are also included, but the invention is not limited thereto.

Examples of carboxylic acid having a valence of three or more include 1,2,4-benzenetricarboxylic acid, 1,2,5-benzenetricarboxylic acid, 1,2,4-naphthalenetricarboxylic acid, anhydrides thereof and lower alkyl esters thereof. They may be used alone or in combination of two or more kinds thereof.

As a polyvalent carboxylic acid component, it is preferable that there is included a dicarboxylic acid component having a sufonic acid group, in addition to the aforementioned aliphatic dicarboxylic acid and aromatic dicarboxylic acid. The dicarboxylic acid having a sulfonic acid group is effective in that it can better dispersing of a coloring material such as a pigment. In the presence of the sulfonic acid group, the whole resin cab be emulsified or suspended in water to prepare fine particles without using a surfactant, as described later.

Examples of dicarboxylic acid having a sulfonic acid include, but are not limited to, 2-sulfoterephthalic acid sodium salts, 5-sulfoisophthalic acid sodium salts, and sulfosuccinic acid sodium salts. Lower alkyl esters and acid anhydrides thereof are also included. These carboxylic acid components having a valence of two or more and having a sulfonic acid group are contained by 0 to 20 mol %, preferably by 0.5 to 100 mol % with respect to the total carboxylic acid component constituting the polyester. When the content thereof is small, stability of emulsified particles is deteriorated with time, while when the content thereof exceeds 10 mol %, crystallizability of the polyester resin is lowered in some cases. In addition, when the toner is prepared by an emulsion aggregation method described later, the process in which particles are fused after aggregation may be adversely affected and problems such as a difficulty in adjusting a toner diameter may occur.

Furthermore, it is more preferable, in addition to the aforementioned aliphatic dicarboxylic acid and aromatic dicarboxylic acid, that a dicarboxylic acid component having a double bond is contained. The dicarboxylic acid having a double bond can suitably be used for preventing a hot offset at fixation for its being capable of radically crosslinking at the double bond. Examples of such kind of the dicarboxylic acid include, but not limited to, maleic acid, fumaric acid, 3-hexenedioic acid and 3-octenedioic acid. Additional examples include lower esters and acid anhydrides thereof. Among them, fumaric acid and maleic acid are preferable from a viewpoint of cost efficiency.

The polyvalent alcohol component is preferably aliphatic diol, and more preferably straight aliphatic diol having carbon atoms of 7 to 20 in the main chain. When the aliphatic diol is a branched type, crystallizability and a melting point of a polyester resin are lowered, thereby a toner blocking resistance, image storability and low-temperature fixability are deteriorated in some cases. When the number of carbon atoms is less than 7, the melting point is elevated and fixation at the low temperature becomes difficult, in a case of being polycondensed with aromatic dicarboxylic acid, in some cases. On the other hand, when the number of carbon atoms exceeds 20, it tends to be difficult to obtain the material for practical use. The aforementioned number of carbon atoms is more preferably 14 or less.

Specific examples of the aliphatic diol which is suitably used in synthesizing the crystalline polyesters and can be used in the toner of the invention include, but not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosandecanediol. In view of the availability, 1,8-octanediol, 1,9-nonanediol and 1,10-decanediol are preferable.

Examples of the alcohols having a valence of three or more include glycerin, trimethylolethane, trimethylolpropane, and pentaerythritol. These may be used alone, or two or more kinds may be used in combination.

Among polyvalent alcohol components, a content of the aliphatic diol component is preferably 80 mol % or more, more preferably 90 mol % or more. When a content of the aliphatic diol component is less than 80 mol %, since crystallizability of a polyester resin is deteriorated, and a melting point is lowered, toner blocking property, image storability and low temperature fixability are deteriorated in some cases.

If necessary, for the purpose of adjusting an acid value or a hydroxyl group value, monovalent acids such as acetic acid and benzoic acid, and monovalent alcohols such as cyclohexanol and benzyl alcohol can also be used.

The method of preparing the crystalline polyester resin is not particularly limited and a general polyester polymerization method of reacting an acid component with an alcohol component can be used. Examples thereof include a direct polycondensation method and a transesterification method, which can be selected depending on the kind of a monomer.

Preparation of a crystalline polyester resin can be performed at a polymerization temperature of 180 to 230° C., inside the reaction system is evacuated if necessary, and the reaction is performed while removing the water and alcohol which are generated at the time of condensation. When a monomer does not dissolve or mutually dissolve under the reaction temperature, a high boiling point solvent may be added as a solubilizer to dissolve the monomer. A polycondensation reaction is performed while distilling off the solubilizing solvent. When a monomer having a poor compatibility is present in the copolymerization reaction, the monomer having a poor compatibility and an acid or an alcohol to be polycondensed therewith may previously be condensed before the polycondensation with a main component.

A resin particle dispersion of the crystalline polyester can be prepared by adjusting the acid value of the resin or performing emulsion dispersing using an ionic surfactant.

Examples of a catalyst which can be used at preparation of the crystalline polyester resin include alkali metal compounds such as sodium and lithium; alkaline earth metal compounds such as magnesium and calcium; metal compounds such as zinc, manganese, antimony, titanium, tin, zirconium and germanium; phosphite compounds, phosphate compounds and amine compounds. Specific examples include the following compounds.

For example, compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenyl phosphite, tris(2,4-t-butylphenyl) phosphite, ethyltriphenylphosphonium bromide, triethylamine and triphenylamine.

The melting point of the crystalline resin is preferably 50 to 110° C., more preferably 60 to 90° C. When the melting point is lower than 50° C., problems in the storability of a toner or the storability of a toner image after fixation occurs in some cases, while when the melting point is higher than 110° C., sufficient degree of low-temperature fixation is not obtained in some cases, as compared with the conventional toners.

A crystalline resin exhibits a plurality of melting peaks in some cases. In the invention, the maximum peak is regarded as a melting point.

Examples of a crystalline vinyl-based resin include vinyl-based resins using long-chain alkyl or alkenyl (meth)acrylic acid esters such as amyl (meth)acrylate, hexyl (meth)acrylate, heptyl (meth)acrylate, octyl (meth)acrylate, nonyl (meth)acrylate, decyl (meth)acrylate, undecyl (meth)acrylate, tridecyl (meth)acrylate, myristyl (meth)acrylate, cetyl (meth)acrylate, stearyl (meth)acrylate, oleyl (meth)acrylate, and behenyl (meth)acrylate. In the specification, the description of "(meth)acryl" means that both of "acryl" or "methacryl" are included.

As an amorphous polymer (amorphous resin), known resin materials can be used, but the amorphous polyester resin is particularly preferable. An amorphous polyester resin used in the invention is mainly obtained by polycondensation of polyvalent carboxylic acids and polyhydric alcohols.

When the amorphous polyester resin is used, adjusting an acid value of the resin or performing emulsion-dispersing using an ionic surfactant or the like is advantageous in that the resin particle dispersion can be easily prepared.

Examples of the polyvalent carboxylic acid include aromatic carboxylic acids such as terephthalic acid, isophthalic acid, phthalic anhydride, trimellitic anhydride, pyromellitic acid and naphthalenedicarboxylic acid; aliphatic carboxylic acids such as maleic anhydride, fumaric anhydride, succinic acid, alkenylsuccinic anhydride and adipic acid; and alicyclic carboxylic acids such as cyclohexanedicarboxylic acid. One kind or two or more kinds of these polyvalent carboxylic acids can be used. Among these polyvalent carboxylic acids, it is preferable to use aromatic carboxylic acids, and it is also preferable to use carboxylic acids having a valence of three or more (trimellitic acid or its anhydride) with dicarboxylic acids for forming a crosslinked structure or a branched structure to secure a favorable fixability.

Examples of the polyhydric alcohol include aliphatic diols such as ethylene glycol, diethylene glycol, triethylene glycol, propylene glycol, butanediol, hexanediol, neopentyl glycol and glycerin; alicyclic diols such as cyclohexanediol, cyclohexanedimethanol and hydrogenated bisphenol A; and aromatic diols such as an ethylene oxide adduct of bisphenol A and a propylene oxide adduct of bisphenol A. One or two or more kinds of these polyhydric alcohols can be used. Among these polyhydric alcohols, aromatic diols and alicyclic diols are preferable, of which aromatic diols are more preferable. In order to secure a favorable fixability, alcohols having a valence of three or more (glycerin, trimethylolpropane, pentaerythritol) may be used with diols for forming a crosslinked structure or a branched structure.

Monocarboxylic acid and/or a monoalcohol can further be added to a polyester resin obtained by polycondensation of polyvalent carboxylic acid and a polyhydric alcohol to esterify a hydroxyl group and/or a carboxylic group at a polymerization end, and adjust the acid value of the polyester resin. Examples of the monocarboxylic acid include acetic acid, acetic anhydride, benzoic acid, trichloroacetic acid, trifluoroacetic acid and propionic anhydride, and examples of the monoalcohol include methanol, ethanol, propanol, octanol, 2-ethylhexanol, trifluoroethanol, trichloroethanol, hexafluoroisopropanol and phenol.

The polyester resin can be prepared by bringing the polyhydric alcohol and the polyvalent carboxylic acid into condensation-reaction according to an ordinary method. For example, the polyester resin can be prepared by placing the polyhydric alcohol, the polyvalent carboxylic acid, and if necessary, a catalyst into a reaction container equipped with a thermometer, a stirrer and a water trickle condenser, heating at 150 to 250° C. in the presence of an inert gas (e.g. nitrogen gas), continuously removing a low-molecular compound which is generated as a byproduct outside a reaction system, stopping the reaction when the acid value reaches a predetermined degree, and cooling to obtain an intended reaction product.

Examples of the catalyst used in synthesizing the polyester resin include esterifying catalysts of organic metals such as dilaurate dibutyltin and dibutyltin oxide, and metal alkoxides such as tetrabutyl titanate. The amount of such catalysts to be added is preferably 0.01 to 1.00% by mass with respect to the total amount of the raw material.

An amorphous polymer which can be used in the toner of the invention preferably has a mass average molecular weight (Mw) of 5,000 to 1,000,000, further preferably 7,000 to 500,000, a number average molecular weight (Mn) is preferably 2,000 to 10,000, and a molecular weight distribution Mw/Mn is preferably 1.5 to 100, further preferably 2 to 60, according to a molecular weight of a tetrahydrofuran (THF) soluble matter measured by a gel permeation chromatography (GPC) method.

When the mass average molecular weight and the number average molecular weight are smaller than the aforementioned range, even though this is effective in terms of low-temperature fixability, hot-offset resistance is intensely deteriorated and a glass transition temperature of the toner is lowered, thereby adverse effects such as toner blocking are caused on storage property in some cases. On the other hand, when the molecular weight is greater than the aforementioned range, even though hot-offset resistance can be sufficiently applied, the low-temperature fixability is deteriorated and exudation of a crystalline polyester phase which is present in the toner is inhibited, thereby the document storability is adversely influenced in some cases. Therefore, by satisfying the aforementioned conditions, obtaining all of the low-temperature fixability, hot-offset resistance and document storability can be made easy.

In the invention, the molecular weight of a resin is calculated by measuring a molecular weight of a THF soluble matter in a THF solution using GPC•HLC-8120 (manufactured by Tosoh Corporation) and column•TSK gel superHM-M (15 cm) (manufactured by Tosoh Corporation), and using a molecular weight calibration curve produced from a monodisperse polystyrene standard sample.

The acid value of the polyester resin (the amount by mg of KOH necessary for neutralizing 1 g of a resin) is preferably 1 to 30 mg KOH/g on the grounds that the aforementioned molecular weight distribution is easily obtained, granulating property of toner particles in an emulsion dispersing method is easily maintained, and a favorable environmental stability of the obtained toner (stability in electrifying property when a temperature or a humidity changes) is easily maintained. The acid value of the polyester resin can be adjusted by controlling a carboxyl group at the end of the polyester, i.e. adjusting a blending ratio and a reaction rate of polyvalent carboxylic acid and a polyhydric alcohol in the raw material. Alternatively, a polyester having a carboxyl group in the main chain can be obtained by using trimellitic anhydride as a polyvalent carboxylic acid component.

Known amorphous polymers such as styrene acryl-based resins can also be used. Examples of a monomer which can be used in this case include styrenes such as styrene, parachlorostyrene and α-methylstyrene; esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; vinylnitriles such as acrylonitrile and methacrylonitrile; vinyl ethers such as vinyl methyl ether and vinyl isobutyl ether; vinyl ketones such as vinyl methyl ketone, vinyl ethyl ketone, and vinyl isopropenyl ketone; polyolefins such as ethylene, propylene and butadiene. A polymer of those monomers, and a copolymer or a mixture obtained by combining two or more kinds of them can be used. Furthermore, non-vinyl condensed-based resins such as epoxy resins, polyester resins, polyurethane resins, polyamide resins, cellulose resins, polyether resins, or a mixture of these non-vinyl condensed-based resins and the aforementioned vinyl-based resins and a graft polymer obtained when a vinyl-based monomer is polymerized in the presence of these non-vinyl condensed-based resins can also be used.

In the case of polyester, a resin particle dispersion can be prepared by a disperser such as a homogenizer using adjustment of the acid value of the resin and neutralizing amine, and when an amorphous polymer is prepared using a vinyl-based monomer, a resin particle dispersion can be prepared by performing emulsion polymerization using an ionic surfactant, and in the case of other resins, if the resin is oily and dissolves in a solvent having a relatively low solubility in water, a resin particle dispersion can be prepared by dissolving the resin in the solvent, dispersing in the form of fine particles in combination with an ionic surfactant and a polymer electrolyte in water by a disperser such as a homogenizer, then heating or reducing the pressure to volatilize the solvent. Using an amorphous resin is advantageous in that a resin particle dispersion can easily be prepared by performing emulsion-dispersing in water.

A particle diameter of the particles in the thus obtained resin particle dispersion can be measured, for example, by a laser diffraction particle size distribution analyzer (trade name LA-700; manufactured by Horiba, Ltd.).

The glass transition temperature of the amorphous polymer which can be used in the invention is preferably 35 to 100° C., and more preferably 50 to 80° C. from a viewpoint of the balance between storage stability and fixability of a toner. When the glass transition temperature is lower than 35° C., there is a tendency that the toner easily causes blocking (a phenomenon that toner particles aggregate to form a mass) during storage or in a developing machine. On the other hand, when the glass transition temperature exceeds 100° C., a fixing temperature of the toner becomes high, which is not preferable.

It is preferable that a softening point of an amorphous polymer is in the range of 80 to 130° C., more preferably in the range of 90 to 120° C. When the softening point is lower than 80° C., a toner and image stability of the toner after fixation and at storage are intensely deteriorated. When the softening point is higher than 130° C., low-temperature fixability is deteriorated.

The softening point of an amorphous polymer denotes an intermediate temperature between a melting initiation temperature and a melting termination temperature measured by a flow tester (trade name CFT-500C; manufactured by Shimadzu Corporation), under the condition of pre-heating: 80° C./300 sec, plunger pressure: 0.980665 MPa, die size: 1 mmϕ×1 mm and temperature raising rate: 3.0° C./min.

-Releasing Agents-

The toner of the invention may contain a releasing agent. The releasing agent is generally used for the purpose of improving releasability.

Examples of the releasing agent which can be used in the toner of the invention include, but are not limited to, minerals such as montan wax, ozokerite, sericin, paraffin wax, microcrystalline wax and Fischer-Tropsch wax, petroleum-based waxes, natural gas-based waxes and modified entities thereof, low molecular weight polyolefins such as polyethylene, polypropylene and polybutene, silicones which exhibit a softening point by heating, fatty acid amides such as oleic acid amide, erucic acid amide, ricinolic acid amide and stearic acid amide, plant-based waxes such as carnauba wax, rice wax, candelilla wax, Japan wax and jojoba oil, and animal-based waxes such as beeswax. Examples of a modification aid component include higher alcohols having carbon atoms of 10 to 18 and a mixture thereof, higher fatty acid monoglycerides having carbon atoms of 16 to 22 and a mixture thereof, which may be used alone or in combination.

-Other Additives-

The toner of the invention may contain other components than the above-listed components. Other components are not particularly limited and can be appropriately selected depending on the purpose from the examples including known various additives which are used in the conventional toners such as inorganic fine particles, organic fine particles and electrification controlling agents. Since the toner of the invention forms a color by itself, a coloring agent such as a pigment, which is used in the conventional toners, is fundamentally unnecessary, but a small amount of the known coloring agent may be used for the purpose of fine adjustment of a color tone when the color is formed, if necessary.

The electrification controlling agent is used for the purpose of improvement and stabilization of electrifying property. As the electrification controlling agent, various electrification controlling agents which are ordinarily used such as dyes consisting of a quaternary ammonium salt compound, a nigrosine-based compound and a complex of aluminum, iron or chromium, and a triphenylmethane-based pigment can be used, and when a toner is prepared by an emulsion aggregation method described later, materials which are hardly dissolved in water are preferable from a viewpoint of controlling an ionic strength which affects stability of aggregated particles formed in a solution, and reducing waste water pollution.

When inorganic fine particles are added to a toner by a wet method, as an electrification controlling agent, examples of such inorganic fine particles include all of the inorganic fine particles which are ordinarily used as an external additive for the surface of the toner such as silica, alumina, titania, calcium carbonate, magnesium carbonate and tricalcium phosphate. In this case, these inorganic fine particles can be utilized by dispersing in a solvent using an ionic surfactant, a polymer acid or a polymer base.

After drying, inorganic particles of silica, alumina, titania, calcium carbonate or the like, or resin particles of vinyl-based resin, polyester, silicone or the like can be added to the surface of the toner of the invention by applying shear in the dry state, as a flowability aid or a cleaning aid, for the purpose of imparting flowability or improving cleaning property, as is the case of for the conventional toners.

Examples of inorganic oxide fine particles to be added to the toner include fine particles of $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$. Fine particles of silica and titania are particularly preferable. It is desirable that the inorganic oxide fine particles have a surface which has previously been hydrophobicization-treated. This hydrophobicization treatment improves powder flowability of a toner, and is more effective in environmental dependency of electrification and carrier pollution resistance.

The aforementioned hydrophobicization treatment can be performed by immersing the inorganic oxide fine particles in a hydrophobicization treating agent. Examples of the hydrophobicization treating agent are not particularly limited, but include a silane coupling agent, a silicone oil, a titanate-based coupling agent and an aluminum-based coupling agent, which may be used alone or in combination of two or more kinds thereof. Among them, a silane coupling agent is preferable.

As the silane coupling agent, for example, any type of chlorosilane, alkoxysilane, silazane and a special silylating agent may be used. Specific examples thereof include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltriethoxysilane, decyltrimethoxysilane, hexamethyldisilazane, N,O-(bistrimethylsilyl)acetamide, N,N-(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, and γ-chloropropyltrimethoxysilane. The amount of the hydrophobicization treating agent is different depending on a kind of the inorganic oxide fine particles, and cannot be indiscriminately defined, but usually is around 1 to 50 parts by mass with respect to 100 parts by mass of the inorganic oxide fine particles.

-Particle Diameter, Shape and the Like of the Toner-

The volume average particle diameter of the toner of the invention is not particularly limited, and can suitably be adjusted according to the structure of the toner, and the kind and the number of color forming sections contained in the toner.

However, when around two to four kinds of color forming sections which can form different colors from each other are contained in the toner (for example, when the toner contains three kinds of color forming sections which can form yellow, cyan and magenta, respectively), the volume average particle diameter of the toner according to each case of the toner structure is preferably in the range as mentioned below.

When the toner structure is a type where color forming sections are dispersed in the toner, as exemplified in FIG. 1, the volume average particle diameter of the toner is preferably in the range of 5 to 40 μm, more preferably in the range of 10 to 20 μm. Additionally, when the toner having a color forming sections-dispersed structure has the aforementioned particle diameter, the volume average particle diameter of photosensitive/thermosensitive capsules contained therein is preferably in the range of 1 to 5 μm, more preferably in the range of 1 to 3 μm.

When the volume average particle diameter of the toner is less than 5 μm, color reproducibility is deteriorated and image concentration is lowered in some cases due to a reduced amount of a color forming component contained in the toner. When the volume average particle diameter of the toner exceeds 40 μm, irregularity of the surface of an image is exaggerated to cause unevenness in gloss on the surface of an image in some cases, and image quality is deteriorated in some cases.

The toner having a color forming sections-dispersed structure, in which a plurality of photosensitive/thermosensitive capsules are dispersed, tends to have a larger particle diameter compared to the conventional toner using a coloring agent which has a small diameter (volume average particle diameter: around 5 to 10 μm). However, resolution of an image is determined by a particle diameter of photosensitive/thermosensitive capsules, not by a particle diameter of a toner, therefore an image with a higher precision can be obtained. In addition, sufficient fluidity can be secured with a small amount of external additives because of an excellent powder fluidity of the toner, which also improves developability and cleanability.

In the case of a toner having a concentric structure, a stripe structure or a radially-segmented structure as exemplified in FIG. 2 to FIG. 4, reducing the diameter thereof is easier compared to the toner having a color forming sections-dispersed structure, since there is no need to form the photosensitive/theremosensitive capsules into particles. The volume average particle diameter of the toner is preferably in the range of 3 to 40 μm, more preferably in the range of 5 to 15 μm. When the volume average particle diameter of the toner is less than 3 μm, preparation of the toner itself becomes difficult in some cases. When the volume average particle diameter of the toner exceeds 40 μm, irregularity of the surface of an image is exaggerated to cause unevenness in gloss on the surface of an image in some cases, and image quality is deteriorated in some cases.

In the toner of the invention, it is preferable that a volume average particle size distribution index GSDv is 1.30 or less, and a ratio of the volume average particle size distribution index GSDv to a number average particle size distribution index GSDp (GSDv/GSDp) is 0.95 or more.

It is more preferable that GSDv is 1.25 or less, and further preferable that the ratio of GSDv to GSDp (GSDv/GSDp) is 0.97 or more.

When GSDv exceeds 1.30, resolution of an image is lowered in some cases, and when the ratio of GSDv to GSDp (GSDv/GSDp) is less than 0.95, problems such as lowering of electrifying property of the toner, scattering of the toner and fogging occur, causing a defect in an image in some cases.

In the invention, a volume average particle diameter of a toner and values of the GSDv and GSDp were measured and calculated as follows.

First, on a particle size range (channel) obtained by dividing a particle size distribution of a toner measured using a measuring equipment such as Coulter Multisizer II (manufactured by Beckman Coulter K.K.), regarding a volume and a number of individual toner particles, an accumulation distribution is drawn from a small diameter side, a particle diameter at accumulation of 16% is defined as a volume average particle diameter D16v, and a number average particle diameter D16p, and a particle diameter at accumulation of 50% is defined as a volume average particle diameter D50v, and a number average particle diameter D50p. Similarly, a particle diameter at accumulation of 84% is defined as a volume average particle diameter D84v and a number average particle diameter D84p. Thereupon, a volume average particle size distribution index (GSDv) is defined as D84v/D16v, and a number average particle size index (GSDp) is defined as $(D84p/D16p)^{1/2}$ and, using these relational expressions, a volume average particle size distribution index (GSDv) and a number average particle size index (GSDp) can be calculated.

It is preferable that a shape factor SF1, represented by the following equation (1), of the toner of the invention is in the range of 110 to 130.

$$SF1=(ML^2/A)\times(\pi/4)\times 100 \quad \text{Equation (1)}$$

In the equation (1), ML represents a maximum length (μm) of a toner, and A represents a projected area ($\mu m^2$) of the toner.

When the shape factor SF1 is less than 110, the toner tends to remain on a surface of an image carrier at the time of transferring where an image is formed, and the toner needs to be removed, thereby a cleaning property at the time of cleaning the remaining toner by a blade or the like tends to easily be deteriorated, causing an image defect is generated in some cases.

On the other hand, when the shape factor SF1 exceeds 130, there is a possibility the toner is destructed by colliding with a carrier in a developing equipment, when the toner is used as a developer. As a result, the amount of a fine powder is increased, leading to contamination of a surface of an image carrier and deterioration of electrifying property due to a releasing agent component exposed on the toner and causing problems such as fogging due to a fine powder, in some cases.

The shape factor SF1 is measured by Luzex image analyzing device (FT, manufactured by NIRECO Corporation) according to the following process: an optical microscope image of toner particles scattered on a glass slide is loaded in Luzex image analyzing device by a video camera, the maximum length (ML) and a projected area (A) of the toner particles of 50 or more are measured, then a square of a maximum length and a projected area of each toner are calculated, thereby the shape factor SF1 is obtained according to the above equation (1).

(Process of Preparing the Toner)

Hereinafter, a process of preparing the toner of the invention will be explained. It is preferable that the toner of the invention is prepared by a known wet method such as an emulsion aggregation method. The wet method is particularly preferable when the toner of the invention has a construction in which a color is formed at least utilizing substance diffusion at the time of heating (e.g. when the aforementioned two or more kinds of components are contained in different matrices). By using the wet method, the highest process temperature at the time of preparation of the toner can be suppressed, and prevention of color forming in the process of preparing the toner can be made easy.

From a viewpoint of preventing color formation in the process of preparing the toner, the highest process temperature when a wet method is used is preferably 90° C. or lower, further preferably 80° C. or lower. However, when the process temperature is too low, preparation of the toner itself becomes difficult, thereby it is preferable that the highest process temperature is 40° C. or higher.

Using a wet method is particularly preferable for preparation of a toner having a structure in which a first component and a second component which form a color when they are brought into reaction with each other, a photo-curable composition, and microcapsules dispersed in the photo-curable composition are contained, the first component is contained in the microcapsule while the second component is contained in the photo-curable composition.

It is particularly preferable that the microcapsules used in the toner having the above structure are thermal-responsive microcapsules, but may be the ones which respond to other stimulations such as light.

In the invention, known wet methods can be utilized, but it is particularly preferable to utilize an emulsion aggregation method since the highest process temperature can be suppressed low, and at the same time, since toners having various structures as exemplified in FIG. 1 and FIG. 2 can easily be prepared.

The toner having the above structure tends to obtain an insufficient particle strength at a process of granulating, as compared with the conventional toners containing a pigment and a binding resin as a main component, due to a large amount of a photo-curable composition comprising a low-molecular component as a main component. In this regard, using the emulsion aggregation method which does not require a high shearing force is preferable.

A process for preparing the toner of the invention by the emulsion aggregation method will be explained in more detail. Generally, the emulsion aggregation method comprises an aggregating process of, after preparation of a dispersion of various materials constituting a toner, forming aggregated particles in a raw material dispersion in which two or more kinds of dispersions are mixed, and a fusing process of fusing aggregated particles formed in the raw material dispersion, and if necessary, between the aggregating process and the fusing process, an attaching process of attaching a component to form a coating layer to the surface of the aggregated particles to form the coating layer thereon (coating layer forming process) is performed.

In the case of the conventional toners using a coloring agent such as a pigment, in the aggregating process, a releasing agent dispersion is used in addition to a resin particle dispersion and a coloring agent dispersion if desired, and in the attaching process, a resin particle dispersion, which may be the same as or different from a resin particle dispersion used in the aggregating process, is used.

In preparation of the toner of the invention, although a kind or a combination of dispersions used as a raw material are different, the toner can be prepared by suitably combining the aggregating process and the fusing process, and if necessary, the attaching process.

Hereinafter, a method of preparing a toner having a color forming section-dispersed structure as exemplified in FIG. 1, or a toner having a concentric structure as exemplified in FIG. 2, utilizing an emulsion aggregation method will be explained in detail.

<Method of Preparing a Toner Having a Color Forming Section-Dispersed Structure by an Emulsion Aggregation Method>

Method of preparing a toner having a color forming section-dispersed structure by an emulsion aggregation method will now be described.

First, to prepare two or more photosensitive/thermosensitive capsule dispersions which are capable of forming different colors, each photosensitive/thermosensitive capsule dispersions is prepared by a process comprising:

(a1) a first aggregating process wherein first aggregated particles are formed in a raw material dispersion comprising a microcapsule dispersion in which microcapsules containing a first component are dispersed and a photo-curable composition dispersion in which a photo-curable composition containing a second component is dispersed;

(b1) an attaching process wherein resin particles are attached to the surface of the first aggregated particles by adding a first resin particle dispersion in which the resin particles are dispersed to the raw material dispersion in which the first aggregated particles are formed; and (c1) a first fusing process wherein the raw material dispersion containing the first aggregated particles having the resin particles which are attached to the surface thereof is heated to fuse the first aggregated particles.

Subsequently, a toner having a structure in which color forming sections are dispersed is obtained by a process comprising:

(d1) a second aggregating process wherein second aggregated particles are formed in a mixed solution in which the two or more photosensitive/thermosensitive capsule dispersions and a second resin particle dispersion in which resin particles are dispersed are mixed; and (e1) a second fusing process in which a second fused particles are obtained by heating the mixed solution containing the second aggregated particles, thereby forming the toner.

The photosensitive/thermosensitive capsule dispersion used in the process (d1) may be of single kind, and the photosensitive/thermosensitive capsules obtained through processes (a1) to (c1) themselves may be utilized as a toner. In addition, a dispersion containing other component may optionally be used together in each process. For example, a dispersion containing a releasing agent may be used in the first aggregating process or the attaching process.

-Preparation of a Dispersion-

A method of preparing a dispersion used in a process for preparing a toner by the aforementioned emulsion aggregation method will be explained below.

A resin particle dispersion is prepared by dispersing resin particles prepared by emulsion polymerization or the like in a solvent using an ionic surfactant. Alternatively, the dispersion is prepared by phase transfer emulsification by dissolving a resin in a solvent in which the resin can be dissolved.

Examples of a dispersing medium used in the resin particle dispersion include an aqueous medium and an organic solvent. Examples of the aqueous medium include water such as distilled water and ion-exchanged water, and alcohols. These aqueous mediums may be used alone or in combination of two or more kinds thereof. In the invention, it is preferable to add and mix a surfactant to the aqueous medium. Examples of the surfactants are not particularly limited, but include anionic surfactants such as sulfuring acid ester salts, sulfonic acid salts, phosphoric acid esters, and soap; cationic surfactants such as amine salt type surfactants and quaternary ammonium salt type surfactants; nonionic surfactants such as polyethylene glycols, alkylphenol ethylene oxide adducts, and polyhydric alcohols.

Among them, the anionic surfactants and the cationic surfactants are preferable. It is preferable that the nonionic surfactant is used with an anionic surfactant or a cationic surfactant. The surfactants may be used alone, or two or more kinds may be used in combination.

Specific examples of the anionic surfactants include sodium dodecylbenzenesulfonate, sodium dodecylsulfonate, sodium alkylnaphthalenesulfonate, and sodium dialkylsulfosuccinate. Specific examples of the cationic surfactants include alkylbenzenedimethylammonium chloride, alkyltrimethylammonium chloride, and distearylammonium chloride. Among them, ionic surfactants such as an anionic surfactant and a cationic surfactant are preferable.

Examples of the organic solvents include ethyl acetate and toluene, which are suitably selected and used according to the kind of the binding resin.

A releasing agent particle dispersion is prepared by dispersing a releasing agent in water with an ionic surfactant or a polymer electrolyte such as a polymer acid and a polymer base, and finely granulating this using an apparatus which can heat the material up to a melting point or higher and can apply a strong shear.

Examples of the apparatus for fine dispersion by the mechanical means include Manton Gaulin high pressure homogenizer (manufactured by Gaulin Co., Ltd.), a continuous supersonic homogenizer (manufactured by Nippon Seiki Co., Ltd.), Nanomizer (manufactured by Nanomizer Co., Ltd.), a microfluidizer (manufactured by Mizuho Industrial Co., Ltd.), a haluru-type homogenizer, a shrusher (manufactured by Mitsui Mining Co., Ltd.), and Cabtron (manufactured by Eurotech Ltd.).

As a microcapsule dispersion, an emulsion in which microcapsules prepared by the aforementioned microcapsulating methods is dispersed in a solution containing a water-soluble binder can be utilized.

A photo-curable composition dispersion can be obtained by adding a resin component such as a water-soluble binder, a solvent component such as water, and a surfactant to each of the components constituting a photo-curable composition and mixing, then finely granulating by an apparatus which can apply a strong shear.

A particle diameter of fine particles contained in each dispersion other than a microcapsule dispersion is preferably 1 μm or less, more preferably in the range of 100 to 300 nm, in order to make it easy to adjust the diameter and a particle size distribution of a toner to a desired value.

-(a1) First Aggregating Process-

In a first aggregating process, first aggregated particles are formed in a raw material dispersion containing a microcapsule dispersion in which microcapsules containing a first component are dispersed, and a photo-curable composition in which a photo-curable composition containing a second component is dispersed.

In the first aggregating process, an aggregating agent is added to the raw material dispersion, then, if necessary, heating to form a first aggregated particles by aggregating the fine particles in the raw material dispersion.

A heating temperature is from room temperature to 40° C. and may be raised to around 60° C., if necessary.

The aggregated particles are formed by adding an aggregating agent at room temperature while stirring with a rotation shearing-type homogenizer, and making a pH of the raw material dispersion acidic (pH=around 2 to 4).

As the aggregating agent used in the first aggregating process, in addition to a surfactant which has a reverse polarity to that of a surfactant used as a dispersing agent to be added to the raw material dispersion, i.e. an inorganic metal salt, a metal complex having a valence of two or more can be preferably used. In particular, the metal complex is preferably used since the amount of a surfactant to be used can be reduced and electrification property is improved.

Examples of the inorganic metal salts include metal salts such as calcium chloride, calcium nitrate, barium chloride, magnesium chloride, zinc chloride, aluminum chloride and aluminum sulfate, and inorganic metal salt polymers such as polyaluminum chloride, polyaluminum hydroxide and calcium polysulfide.

Particularly, the aluminum salt and a polymer thereof are preferable. From a viewpoint of obtaining a sharper particle size distribution, the inorganic metal salt is more preferably divalent than monovalent, trivalent than divalent, tetravalent than trivalent, and the polymerization-type inorganic metal salt polymer is more preferable than other inorganic metal salts when the valence thereof is the same.

-(b1) Attaching Process-

In an attaching process, the first resin particle dispersion in which resin particles are dispersed is added to the raw material dispersion in which the first aggregated particles are formed to attach the resin particles to the surface of the first aggregated particles, thereby a coating layer, which corresponds to an outer shell part of photosensitive/thermosensitive capsules, can be formed.

The coating layer can be formed by further adding a first resin particle dispersion to a dispersion in which the first aggregated particles (core particles) are formed in the aggregating process. A binding resin component to be used in the first resin particle dispersion may be either a crystalline resin or an amorphous resin, and a releasing agent dispersion may also be used with the first resin particle dispersion. Alternatively, the releasing agent dispersion may be used instead of the first resin particle dispersion.

A surfactant may be used for emulsion-polymerizing of the binding resin, dispersing of each fine particle component, aggregating of the fine particles, and stabilizing of the aggregated particles. Specifically, anionic surfactants such as sulfuring acid ester salts, sulfonic acid salts, phosphoric acid esters and soaps, and cationic surfactants such as amine salt type surfactants and quaternary ammonium salt type surfactants can be used, and nonionic surfactants such as polyethylene glycols, alkylphenol ethylene oxide adducts, and polyhydric alcohols are also effective to be used together. As a means for dispersing, commonly used ones such as a rotation shearing-type homogenizer, and mills having media such as a ball mill, a sand mill and a Dyno mill can be used.

-(c1) First Fusing Process-

In the first fusing process, the raw material dispersion containing the first aggregated particles with resin particles attached to the surface thereof are heated to fuse to obtain first fused particles (photosensitive/thermosensitive capsules).

In the first fusing process, progression of aggregation is stopped by adjusting a pH of a suspension containing the aggregated particles obtained through the first aggregating process and the attaching process in the range of around 6.5 to 8.5, then the suspension is heated to fuse aggregated particles.

Heating is performed at a temperature of a glass transition temperature or a melting point of a binding resin (and/or a releasing agent) used in formation of a coating layer or higher.

The heating temperature is set to such an extent that materials constituting an outer shell of microcapsules is melted or the like and does not disappear, and generally, is determined in view of heat resistance of materials constituting the outer shell of microcapsules and a temperature at which materials forming the outer shell of photosensitive/thermosensitive capsules can be fused, and generally is preferably in the range of 40 to 90° C., more preferably in the range of 50 to 80° C.

When the heating temperature exceeds 90° C., the outer shell of microcapsules disappears and a color is formed in some cases. When the heating temperature is lower than 40° C., the photosensitive/thermosensitive capsules do not sufficiently fuse and disintegrate in following processes in some cases.

-(d1) Second Aggregating Process-

The above-described processes of (a1) to (c1) are performed for each kind (each color to be formed) of a photosensitive/thermosensitive capsules to be dispersed in a toner, thereby two or more photosensitive/thermosensitive capsule dispersions which are capable of forming different colors from each other are prepared.

Subsequently, in a second aggregating process, second aggregated particles are formed in a mixed solution obtained by mixing two or more kinds of photosensitive/thermosensitive capsule dispersions and a second resin particle dispersion in which resin particles are dispersed. If necessary, dispersions of other components such as a releasing agent dispersion may be added thereto.

The second aggregating process is essentially performed in the same manner as the first aggregating process, except that a composition of a solution used for aggregation is different. Specifically, the second aggregated particles are formed by heating the mixed dispersion after an aggregating agent is added thereto to aggregate photosensitive/thermosensitive capsule particles and resin particles. It is preferable that the surface of the second aggregated particles is coated with amorphous resin particles by further adding a resin particle dispersion in which amorphous resin particles are dispersed at a process of forming the second aggregated particles or after the second aggregated particles are formed.

The heating temperature is preferably a temperature at which amorphous resin particles can fuse together or fuse with other materials, specifically higher than a glass transition temperature of the amorphous resin particles by several degrees to several tens of degrees.

-(e1) Second Fusing Process-

In a second fusing process, the mixed solution containing the second aggregated particles is heated to obtain second fused particles (toners in a state of being wet).

In the second fusing process, the aggregated particles are fused by heating after progression of aggregation is stopped by making a pH of a suspension containing the aggregated particles obtained in the second aggregating process in the range of around 6.5 to 8.5.

The heating is performed at a glass transition temperature or a melting point of a binding resin used for forming the second aggregated particles or higher.

The heating temperature is determined in view of heat resistance of materials constituting an outer shell of microcapsules, heat resistance of materials forming the outer shell of photosensitive/thermosensitive capsules, and a temperature at which the binding resin used for forming the second aggregated particles can fuse, which is generally preferably in the range of 40 to 90° C., more preferably in the range of 50 to 70° C.

When the heating temperature exceeds 90° C., the outer shell of microcapsules disappears and a color is formed, or the second component dispersed in the photosensitive/thermosensitive capsules which can form a single color is diffused outside the photosensitive/thermosensitive capsules, and further into photosensitive/thermosensitive capsules which can form another color, thereby sufficient color formation is not obtained at the time of image formation in some cases.

When the heating temperature is lower than 40° C., sufficient fusion is not performed and toner particles are disintegrated at the subsequent processes such as washing and drying in some cases.

-Washing and Drying Processes and the Like-

After the second fusing process, desired toner particles are obtained through optional processes of washing, solid-liquid separating and drying. From a viewpoint of electrification property, it is preferable that substitution washing with ion-exchanged water is sufficiently performed in the washing process. The solid-liquid separating process is not particularly limited, but from a viewpoint of productivity, suction filtration, pressure filtration or the like is preferable. Furthermore, the drying process is also not particularly limited, but from a viewpoint of productivity, lyophilization, flash jet drying, flowing drying or vibration-type flowing drying is preferable. Various external agents described above may be added to the toner particles after drying, if necessary.

<Process for Preparing a Toner Having a Concentric Structure by an Emulsion Aggregation Method>

Next, process for preparing a toner having a concentric structure by an emulsion aggregation method will be described.

First, a photosensitive/thermosensitive capsule dispersion is prepared by the process comprising:

(a2) a first aggregating process wherein first aggregated particles are formed in a raw material dispersion comprising a first microcapsule dispersion in which microcapsules containing a first component are dispersed and a first photo-curable composition dispersion in which a photo-curable composition containing a second component is dispersed;

(b2) an attaching process wherein resin particles are attached to the surface of the first aggregated particles by adding a first resin particle dispersion in which the resin particles are dispersed to the raw material dispersion in which the first aggregated particles are formed; and (c2) a first fusing process wherein photosensitive/thermosensitive capsules are obtained by heating the raw material dispersion containing the first aggregated particles having the resin particles which are attached to the surface thereof to fuse the first aggregated particles.

Subsequently, a toner having a concentric structure is obtained by a process comprising:

(d2) a photosensitive/thermosensitive layer forming process wherein a photosensitive/thermosensitive layer capable of forming a color which is different from the color of the photosensitive/thermosensitive capsules is formed on the surface of the photosensitive/thermosensitive capsules by adding a raw material dispersion comprising a second microcapsule dispersion in which microcapsules containing a first component is dispersed and a second photo-curable composition dispersion in which a photo-curable composition containing a second component, to the photosensitive/thermosensitive capsule dispersion;

(e2) a coating layer forming process wherein the resin particles are attached to the surface of the photosensitive/thermosensitive layer to form a coating layer by adding a second resin particle dispersion in which resin particles are dispersed to the raw material dispersion which has undergone the photosensitive/thermosensitive layer forming process; and (f2) a second fusing process in which fused particles are obtained by heating the raw material dispersion containing a second aggregated particles on which the coating layer is formed by attaching the resin particles to the surface of the photosensitive/thermosensitive layer.

When a toner having a concentric structure containing three or more kinds of color forming sections which are capable of forming different colors respectively is prepared, a process of performing (d2) a photosensitive/thermosensitive layer forming process, (e2) a coating layer forming process and (f2) a second fusing process in this order is further repeated one or more times. In this way, colors which can be formed by two or more photosensitive/thermosensitive layers which are respectively formed in the photosensitive/thermosensitive layer forming process and the photosensitive/thermosensitive capsules can be made different.

In each process, a dispersion containing other components can optionally be used in combination. For example, a releasing agent dispersion may be used in the first aggregating process, the attaching process, the photosensitive/thermosensitive layer forming process and a coating layer forming process.

Next, each of the processes will be explained in more detail. As for the process for preparing each dispersion used in each process, it is the same as the case where a toner having a color forming section-dispersed structure is prepared.

Processes of (a2) to (c2) can also be performed essentially in the same manner as the aforementioned processes of (a1) to (c1), except that the photosensitive/thermosensitive capsule dispersion prepared through the processes of (a2) to (c2) is only one kind.

Subsequently performed processes of (d2) the photosensitive/thermosensitive layer forming process and (e2) the coating layer forming process can be performed in the same manner as the above-described processes of (a1) and (b1), except that the photosensitive/thermosensitive layer and the coating layer are sequentially laminated on the photosensitive/thermosensitive capsule particles which is to be a core layer (core particles). In this way, the second aggregated particles comprising the photosensitive/thermosensitive capsule particles as a core layer, and the photosensitive/thermosensitive layer and the coating layer which are sequentially laminated to coat the core layer, is obtained.

The coating layer formed in (e2), the coating layer forming process, constitutes a surface layer which finally coats the surface of a toner, or an intermediate layer provided between two photosensitive/thermosensitive layers which are adjacently in contact with each other. When this coating layer constitutes a surface layer of a toner, it is particularly preferable that a resin particle dispersion using an amorphous resin is used in the process (e2).

The second fusing process (F2) can also be performed essentially in the same manner as the aforementioned process (e1). The heating temperature in the second fusing process is determined in view of heat resistance of materials constituting an outer shell of microcapsules, heat resistance of materials forming the outer shell of the photosensitive/thermosensitive capsules and heat resistance of materials of materials forming an intermediate layer (when processes (d2) to (f2) are repeated twice or more), and a temperature at which a binding resin used for forming the second aggregated particles can be fused, which is generally preferably in the range of 40 to 90° C., more preferably in the range of 50 to 80° C.

When the heating temperature exceeds 90° C., the outer shell of microcapsules disappear and a color is formed, or the second component dispersed in the color forming section which can form a single color (photosensitive/thermosensitive capsules and/or a photosensitive/thermosensitive layer) is diffused outside the color forming section (photosensitive/thermosensitive capsules and/or a photosensitive/thermosensitive layer), or further into a color forming section which can form another color (photosensitive/thermosensitive capsules and/or a photosensitive/thermosensitive layer), thereby sufficient color formation is not obtained at the time of image formation in some cases.

When the heating temperature is lower than 40° C., fusion is not sufficiently performed and the toner particle is disintegrated in the subsequent processes of washing, drying and the like, in some cases.

After a round of above-explained processes is performed, a washing process and a drying process are performed as described above to obtain a toner.

(Developer for Electrostatic Charging Image Development)

The toner of the invention may be used as is as a single component developer, but it is preferably used as a toner in a two-component developer consisting of a carrier and a toner, in the invention.

The carrier which can be used in a two-component developer is preferably the one in which the surface of a core material is coated with a resin. The core material of the carrier is not particularly limited as long as it satisfies the aforementioned conditions, but examples thereof include magnetic metals such as iron, steal, nickel and cobalt, alloys of these magnetic metals and manganese, chromium or rare earths, and magnetic oxides such as ferrite and magnetite. From a viewpoint of core material surface property and core material resistance, preferable examples include ferrite, and in particular, alloys with manganese, lithium, strontium or magnesium.

The resin for coating the surface of the core material is not particularly limited as long as it can be used as a matrix resin, and can be suitably selected depending on the purpose. Examples thereof include known per se resins e.g. polyolefin-based resins such as polyethylene and polypropylene; polyvinyl-based resins and polyvinylidene-based resins such as polystyrene, acryl resins, polyacrylonitrile, polyvinyl acetate, polyvinyl alcohol, polyvinyl butyral, polyvinyl chloride, polyvinyl carbazole, polyvinyl ether and polyvinyl ketone; a vinyl chloride-vinyl acetate copolymer; a styrene-acrylic acid copolymer; straight silicone resins comprising an organosiloxane bond or modified products thereof; fluorine-based resins such as polytetrafluoroethylene, polyvinyl fluoride, polyvinylidene fluoride and polychlorotrifluoroethylene; silicone resins; polyester; polyurethane; polycarbonate; phenol resins; amino resins such as a urea-formaldehyde resin, melamine resin, a benzoguanamine resin, a urea resin and a polyamide resin; and epoxy resins. These resins may be used alone, or in combination of two or more kinds thereof. In the invention, among these resins, it is preferable to use at least a fluorine-based resin and/or a silicone resin. Using at least a fluorine-based resin and/or a silicone resin as the aforementioned resin is advantageous in that the effect of preventing carrier contamination (impaction) due to a toner or an external additive is high.

The coating film comprises the aforementioned resin in which at least resin particles and/or electrically conductive particles are dispersed. Examples of the resin particles include thermoplastic resin particles and thermosetting resin particles. Among them, thermosetting resins are preferable from a viewpoint that increasing hardness is relatively easy, and resin particles of a nitrogen-containing resin containing an N atom are preferable from a viewpoint of applying a negative electrification property to a toner. These resin particles may be used alone, or in combination of two or more kinds thereof. The average particle diameter of the resin particles is preferably around 0.1 to 2 μm, more preferably 0.2 to 1 μm. When the average particle diameter of the resin particles is less than 0.1 μm, dispersibility of the resin particles in the coating film is poor, and, on the other hand, when the average particle diameter exceeds 2 μm, the resin particles are easily detached from the coating film, and the original effect is not exerted in some cases.

Examples of the electrically conductive particles include metal particles of gold, silver, copper and the like, carbon black particles, semiconducting oxide particles of titanium oxide, zinc oxide and the like, and particles in which the surface of powder of titanium oxide, zinc oxide, barium sulfate, aluminum borate, potassium titanate or the like is covered with tin oxide, carbon black or a metal. These may be used alone, or two or more kinds may be used in combination. From a viewpoint of better preparation stability, cost efficiency and electrical conductivity, carbon black particles are preferable. The kind of carbon black is not particularly limited, but carbon black having a DBP oil absorbing amount of around 50 to 250 ml/100 g, being excellent in preparation stability, is preferable.

A method of coating the surface of the core material of the carrier with a resin is not particularly limited, but examples thereof include a method using a coating film forming solution in which the aforementioned resin particles such as cross-linking resin particles and/or the aforementioned electrically conductive particles, and the aforementioned resin such as a styrene acryl resin, a fluorine-based resin and a silicone resin as a matrix resin are contained in a solvent.

Examples of a resin coating method include an immersion method of immersing the aforementioned carrier core material in the aforementioned coating film forming solution, a spray method of spraying the coating film forming solution to the surface of the carrier core material, and a kneader coater method of mixing the coating film forming solution and the carrier core material being floated by a flowing air, and removing a solvent. Among them, in the invention, the kneader coater method is preferable.

The solvent used in the coating film forming solution is not particularly limited as long as it can dissolve only the above resin as a matrix resin, but can be selected from known per se solvents, and examples thereof include aromatic hydrocarbons such as toluene and xylene, ketones such as acetone and methyl ethyl ketone, and ethers such as tetrahydrofuran and dioxane. In the case where the resin particles are dispersed in the coating film, since the resin particles and the particles as a matrix resin are uniformly dispersed in the thickness direction thereof and in the tangential direction to the surface of the carrier, even when the carrier is used for a long term and the coating film is abraded, surface formation which is similar to that of unused ones can constantly be retained, and a favorable ability of applying electrification to the toner can be maintained over a long period of time. In the case where the electrically conductive particles are dispersed in the coating film, since the electrically conductive particles and the resin as a matrix resin are uniformly dispersed in the thickness direction thereof and in a tangential direction to the surface of the carrier, even when the carrier is used for a long term and the coating film is abraded, surface formation which is similar to that of unused ones can constantly be retained, and deterioration of the carrier can be prevented over a long period of time. In the case where the resin particles and the electrically conductive particles are dispersed in the coating film, the aforementioned effects can be exerted at the same time.

The mixing ratio (mass ratio) of the toner of the invention and the carrier (toner:carrier) is preferably in the range of around 1:100 to 30:100, more preferably in the range of around 3:100 to 20:100.

(Image Forming Method)

Image formation using the toner of the invention can be performed by a process in which a process of applying external stimulation for making a toner form a color is applied to an image forming process of ordinary electrography.

For example, an image forming method can be used, such as an image forming method using the toner of the invention comprising an electrification process of electrifying the surface of an image carrier, a latent image forming process of forming an electrostatic latent image on the surface of the image carrier, a developing process of developing the electrostatic latent image with a developer containing a toner to form a toner image, a color forming information imparting process of imparting color forming information with light corresponding to color component information of image information to the toner image, a transferring process of transferring the toner image after light exposure onto the surface of a recording medium, and a fixing/color forming process of forming an image by heating and pressing the toner image on the surface of the recording medium to fix and form a color. In this image forming method, a toner having the following construction can be utilized.

"Imparting of color forming information with light" means selectively imparting one or more kinds of light having a specified wavelength for curing a photo-curable composition, or imparting no light, to a desired region of a toner image in order to control color formation/no color formation of each toner particle constituting the toner image, and to control a tone when the color is formed.

Specifically, in the above-described image forming method, there can be used a toner which comprises one or more kinds of color forming sections containing a first component and a second component which are present in the state of being isolated from each other and form a color when they are brought into reaction with each other, and a photo-curable composition containing any one of the first component and the second component, maintains a state of not being capable of forming a color when the photo-curable composition is in a state of being uncured, and is irreversibly controlled from a state of not being capable of forming a color to a state of being capable of forming a color by irradiating light having a specified wavelength of curing the photo-curable composition to cure the photo-curable composition. As a toner having such construction, the described photo-developable toner can be utilized. Examples of the light corresponding to color component information of image information used in a color forming information imparting process include light having a specified wavelength of curing a photo-curable composition contained in each of one or more kinds of color forming sections contained in toner particles.

In image formation using such kind of toner, since light having a specified wavelength corresponding to color component information of image information is irradiated to each toner particle constituting a toner image in a process of imparting color forming information, a photo-curable composition in each kind of a color forming section in a toner is respectively transferred to a state of being cured or maintains the state of being uncured, thereby is controlled to the state of being capable of forming a color or to the state of not being capable of forming a color, according to the kind of the color forming section. Subsequently, since only a color forming section in the state of being capable of forming a color selectively forms a color by heating in a fixing/color forming process which is performed after a transferring process, a monotone or color image depending on image information is obtained. From a viewpoint of color formation of a toner by imparting external stimulation (controlling stimulation and color forming stimulation), a color forming information imparting process corresponds to imparting of control stimulation, and a fixing/color forming process corresponds to imparting of color forming stimulation.

It is preferable that a light irradiation process of irradiating an image obtained in a fixing/color forming process with light is included. In this process, a first component and a second component which are controlled to the state of not being capable of forming a color and remain in a color forming section can be disintegrated or inactivated, thereby suppression of change in color balance after image formation can be made more reliable.

In addition, in the aforementioned image forming method, known processes utilized in an electrophotography process which is performed using a conventional coloring agent such as a pigment, for example, a cleaning process of cleaning the surface of an image carrier after a toner image is transferred with a cleaning blade may be included. In addition, a transferring process may be the one in the form of intermediate transferring which comprises a first transferring process of transferring a toner image from an image carrier to an intermediate transfer body such as an intermediate transfer belt, and a second transferring process of transferring a toner image transferred onto the intermediate transfer body onto a recording medium.

It is preferable that three kinds of color forming sections are contained in a toner and, for example, it is preferable that these three kinds of color forming sections are a yellow color forming section which can form a yellow color, a magenta color forming section which can form a magenta color, and a cyan color forming section which can form a cyan color.

In the image forming method using the toner of the invention, in which only one kind of a toner is required even for forming a full color image, there is no need to use plural image forming units corresponding to each color of a toner as is the case for a tandem type, therefore the size can be reduced to a degree nearly equal to that of a conventional monochromic type copying machine.

In addition, since there is no need of layering a toner of each color when forming a toner image, irregularities on the surface of the image can be suppressed and uniformity in gloss at the surface of the image is favorable. Furthermore, since a coloring agent such as a pigment is not used, a silver salt-like image can be obtained.

As the image carrier, known photoreceptors, for example, a photoreceptor having an inorganic photosensitive layer comprising Se, α-Si or the like, or a single or a plurality of organic layers on an electrically conductive substrate can be utilized.

In an electrification process, known electrifying means can be used. When the electrifying means is contact type, a roll, a brush, a magnetic brush, a blade or the like can be used, and when the electrifying means is non-contact type, a corotron, a scorotron or the like can be used.

In a latent image forming process, known means for light exposing can be used, and examples include laser ROS, and a LED image bar. As a means for developing used in a developing process, known means for development of either contact development or non-contact development can be used, and a developer to be used may be either one component system or two component system.

In a color forming information imparting process, as a means for light exposing (means for color forming information imparting) for forming a color of a developed toner image, known light sources can be utilized as long as it can irradiate light in a wavelength which can control a toner to be used so that the toner is in a state of being capable of forming a color or a state of not being capable of forming a color at a predetermined resolution. For example, an LED image bar and laser ROS can be utilized.

The wavelength of light emitted by the light source can be selected depending on the wavelength in which a photo-curable composition contained in each kind of a color forming section of a toner to be used can be cured.

For example, when color formation of yellow, magenta and cyan is controlled utilizing three kinds of wavelength, light having a wavelength of 450 nm can be irradiated for forming a yellow color, light having a wavelength of 550 nm is irradiated for forming a magenta color, and light having a wavelength of 650 nm can be irradiated for forming a cyan color. In this case, when forming a secondary color, two of the lights having above-mentioned three wavelengths can be irradiated in combination.

In a transferring process, known means for transferring can be used. In the case of a contact type, a roll, a brush, and a blade can be used and, in the case of a non-contact type, a corotron, a scorotron, and a pincorotron can be used. Alternatively, transferring by means of pressure, or pressure and heat is also possible.

As a means for fixing/color forming used in a fixing/color forming process, known fixation means utilized in an image forming apparatus using the conventional toner containing a coloring agent such as a pigment can be used.

As a heating member and a pressurizing member constituting a fixing means, each of them can be utilized in combination with a roll or a belt, and as a heat source, a halogen lamp, IH and the like can be used.

A means for light irradiation used in a light fixation process is used for preventing further progression of color formation a toner in an image after fixation and color formation, and known lamps such as a fluorescent lamp, LED and EL can be used.

Hereinafter, illustrative embodiments of the present invention will be described.

1. A toner for electrostatic latent image development comprising a first component and a second component which are isolated from each other and capable of forming a color when the first component and the second component are brought into reaction with each other, and a photo-curable composition containing either the first component or the second component, the photo-curable composition not being capable of forming a color when the photo-curable composition is not cured, that is irreversibly controlled to a state of being capable of forming a color by irradiating light having a specific wavelength at which the photo-curable composition is cured.

2. The toner for electrostatic latent image development according to 1, wherein the photo-curable composition contains microcapsules which are dispersed therein, the first component is contained in the microcapsules and the second component is contained in the photo-curable composition.

3. The toner for electrostatic latent image development according to 2, wherein the microcapsules are thermo-reactive microcapsules which enables substance diffusion between inside and outside the microcapsules by a heating treatment.

4. The toner for electrostatic latent image development according to 2, wherein the microcapsules comprise a core part which contains the first component and an outer shell that coats the core part, the outer shell comprising a thermoplastic material.

5. The toner for electrostatic latent image development according to 2, wherein the second component and a photo-polymerizable compound are contained in the photo-curable composition.

6. The toner for electrostatic latent image development according to 1, wherein the first component and the second component are brought into reaction with each other to develop a color by heating after the photo-curable composition is irreversibly controlled so as to be capable of forming a color by irradiating the light having a specific wavelength to cure the photo-curable composition.

7. The toner for electrostatic latent image development according to 2, wherein the toner comprises two or more color forming sections comprising the photo-curable composition and microcapsules which are dispersed in the photo-curable composition.

8. The toner for electrostatic latent image development according to 7, wherein the two or more color forming sections comprise two or more kinds of color forming sections which are capable of forming different colors from each other.

9. The toner for electrostatic latent image development according to 8, wherein the two or more color forming sections comprise a yellow color forming section which is capable of forming yellow, a magenta color forming section which is capable of forming magenta, and a cyan color forming section which is capable of forming cyan.

10. The toner for electrostatic latent image development according to 7, wherein the toner comprises a base material comprising a bonding resin as a major component and each of the two or more color forming sections are dispersed in the base material in the form of particles.

11. The toner for electrostatic latent image development according to 10, wherein the color forming sections which are dispersed in the form of particles comprise a core part and an outer shell that coats the core part, the outer shell containing a material which is insoluble in water.

12. The toner for electrostatic latent image development according to 7, wherein at least one of the two or more color forming sections is in contact adjacently with at least one of the other color forming sections so as to form an interface.

13. The toner for electrostatic latent image development according to 12, wherein a layer comprising a non-water-soluble material is formed at the interface of the one color forming section and the other color forming sections.

14. The toner for electrostatic latent image development according to 4, wherein the thermoplastic material is an amorphous resin and the amorphous resin has a glass transition temperature of approximately 90 to approximately 200° C.

15. The toner for electrostatic latent image development according to 1, wherein the toner is produced by utilizing an emulsion aggregation method.

16. The toner for electrostatic latent image development according to 1, wherein the toner is produced by utilizing a wet method and the highest processing temperature in the wet method is approximately 90° C. or less.

17. A method of producing a toner utilizing a wet method, the toner comprising a first component and a second component which are isolated from each other and capable of forming a color when the first component and the second component are brought into reaction with each other, and a photo-curable composition containing either the first component or the second component, the photo-curable composition not being capable of forming a color when the photo-curable composition is not cured, that is irreversibly controlled to a state of being capable of forming a color by irradiating light having a specific wavelength at which the photo-curable composition is cured.

18. The method of producing a toner according to 17, wherein the photo-curable composition contains microcapsules which are dispersed therein, the first component is contained in the microcapsules and the second component is contained in the photo-curable composition.

19. The method of producing a toner according to 17, wherein the wet method includes an emulsion aggregation method.

20. The method of producing a toner according to 17, wherein the highest processing temperature in the wet method is approximately 90° C. or less.

21. The method of producing a toner according to 18, wherein the method comprises a process to prepare two or more photosensitive/thermosensitive capsule dispersions which are capable of forming different colors from each other, each dispersion being formed by a process comprising:

a first aggregating process wherein first aggregated particles are formed in a raw material dispersion comprising a microcapsule dispersion in which microcapsules containing a first component are dispersed and a photo-curable composition dispersion in which a photo-curable composition containing a second component is dispersed;

an attaching process wherein resin particles are attached to the surface of the first aggregated particles by adding a first resin particle dispersion in which the resin particles are dispersed to the raw material dispersion in which the first aggregated particles are formed; and a first fusing process wherein the raw material dispersion containing the first aggregated particles having the resin particles which are attached to the surface thereof is heated to fuse the first aggregated particles, and the method further comprising:

a second aggregating process wherein second aggregated particles are formed in a mixed solution in which the two or more photosensitive/thermosensitive capsule dispersions and a second resin particle dispersion in which resin particles are dispersed are mixed; and a second fusing process in which a second fused particles are obtained by heating the mixed solution containing the second aggregated particles, thereby forming the toner.

22. The method of producing a toner according to 18, wherein the method comprises a process to prepare a photosensitive/thermosensitive capsule dispersion, the process comprising:

a first aggregating process wherein first aggregated particles are formed in a raw material dispersion comprising a first microcapsule dispersion in which microcapsules containing a first component are dispersed and a first photo-curable composition dispersion in which a photo-curable composition containing a second component is dispersed;

an attaching process wherein resin particles are attached to the surface of the first aggregated particles by adding a first resin particle dispersion in which the resin particles are dispersed to the raw material dispersion in which the first aggregated particles are formed; and a first fusing process wherein photosensitive/thermosensitive capsules are obtained by heating the raw material dispersion containing the first aggregated particles having the resin particles which are attached to the surface thereof to fuse the first aggregated particles, and the method further comprising:

a photosensitive/thermosensitive layer forming process wherein a photosensitive/thermosensitive layer capable of forming a color which is different from the color of the photosensitive/thermosensitive capsules is formed on the surface of the photosensitive/thermosensitive capsules by adding a raw material dispersion comprising a second microcapsule dispersion in which microcapsules containing a first component is dispersed and a second photo-curable composition dispersion in which a photo-curable composition containing a second component, to the photosensitive/thermosensitive capsule dispersion;

a coating layer forming process wherein the resin particles are attached to the surface of the photosensitive/thermosensitive layer to form a coating layer by adding a second resin particle dispersion in which resin particles are dispersed to the raw material dispersion which has undergone the photosensitive/thermosensitive layer forming process; and a second fusing process in which fused particles are obtained by heating the raw material dispersion containing a second aggregated particles on which the coating layer is formed by attaching the resin particles to the surface of the photosensitive/thermosensitive layer, thereby forming the toner.

23. The method of producing a toner according to 22, wherein the process in which the photosensitive/thermosensitive layer forming process, the coating layer forming process and the second fusing process are conducted in this order is further repeated one or more times, and the colors of the two or more photosensitive/thermosensitive layers which are formed by respective photosensitive/thermosensitive layer forming processes and the photosensitive/thermosensitive capsules are different from each other.

24. A method of producing a toner containing a color-changeable substance wherein the toner is produced by utilizing a wet method.

25. The method of producing a toner according to 24, wherein the toner containing the color-changeable substance changes the color thereof by being applied at least one stimulation selected from light and heat.

26. The method of producing a toner according to 24, wherein the wet method includes an emulsion aggregation method.

27. The method of producing a toner according to 26, wherein the highest processing temperature in the wet method is approximately 90° C. or less.

28. A developer for electrostatic latent image development containing a toner comprising a first component and a second component which are isolated from each other and capable of forming a color when the first component and the second component are brought into reaction with each other, and a photo-curable composition containing either the first component or the second component, the photo-curable composition not being capable of forming a color when the photo-curable composition is not cured, that is irreversibly controlled to a state of being capable of forming a color by irradiating light having a specific wavelength at which the photo-curable composition is cured.

EXAMPLES

The invention will now be explained in more detail with reference to the following examples, but the invention is not limited thereto. In the following preparation of a toner, preparation of a photo-curable composition dispersion and a series of preparation of the toner using the photo-curable composition dispersion are all performed at a dark place.

-Preparation of a Microcapsule Dispersion (1)-

12.1 parts by mass of an electron donating colorless dye (1) is dissolved in 10.2 parts by mass of ethyl acetate, and 12.1 parts by mass of dicyclohexyl phthalate, 26 parts by mass of Takenate D-110N (manufactured by Takeda Pharmaceutical Company Limited) and 2.9 parts by mass of Millionate MR200 (manufactured by Nippon Polyurethane Industry Co., Ltd.) are added thereto, to prepare a solution.

The above solution is added to a mixed solution of 5.5 parts by mass of polyvinyl alcohol and 73 parts by mass of water, and the solution is subjected to emulsification-dispersion at 20° C. to obtain an emulsion having an average particle diameter of 0.5 μm. The obtained emulsion is added 80 parts by mass of water and heated while being stirred so that the temperature thereof is 60° C., then a microcapsule dispersion (1), in which microcapsules containing the electron donating colorless dye (1) as a core material are dispersed, is prepared after two hours.

The glass transition temperature of a material constituting an outer shell of microcapsules contained in the microcapsule dispersion (1) (a material obtained by bringing dicyclohexyl phthalate, Takenate D-110N and Millionate MR200 into reaction under the almost same condition as that of the above) is about 130° C.

-Preparation of a Microcapsule Dispersion (2)-

A microcapsule dispersion (2) is prepared according to the same manner as that of preparing the microcapsule dispersion (1) except that the electron donating colorless dye (1) is changed to an electron donating colorless dye (2), -Preparation of a Microcapsule Dispersion (3)-

A microcapsule dispersion (3) is prepared according to the same manner as that of preparing the microcapsule dispersion (1) except that the electron donating colorless dye (1) is changed to an electron donating colorless dye (3).

Chemical structures of electron donating colorless dyes (1) to (3) used in preparation of microcapsule dispersions are shown below.

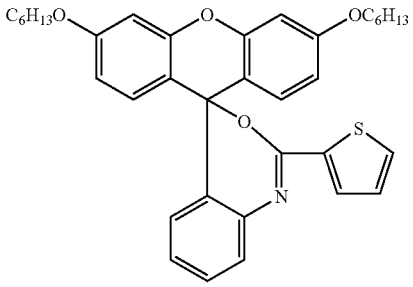

Electron donating colorless dye (1)

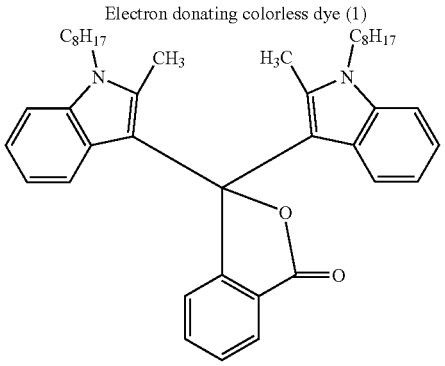

Electron donating colorless dye (2)

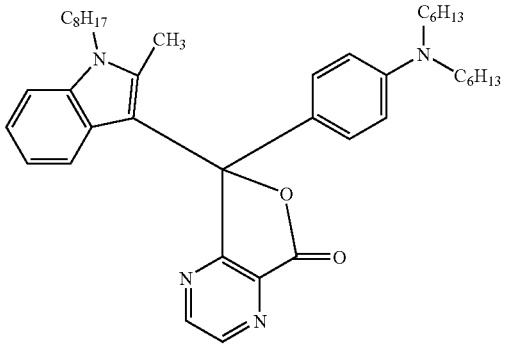

Electron donating colorless dye (3)

-Preparation of a Photo-Curable Composition Dispersion (1)-

9 parts by mass of an electron accepting compound (1) and 7.5 parts by mass of a trimethylolpropane triacrylate monomer (trifunctional acrylate, molecular weight of about 300) are added to a solution in which 1.62 parts by mass of a photopolymerization initiator (1-a) and 0.54 parts by mass of a photopolymerization initiator (1-b) are dissolved in 4 parts by mass of ethyl acetate.

The thus obtained solution is added to a mixed solution in which 19 parts by mass of a 15 mass % PVA (polyvinyl alcohol) aqueous solution, 5 parts by mass of water, 0.8 parts by mass of a 2 mass % surfactant (1) aqueous solution and 0.8 parts by mass of a 2 mass % surfactant (2) aqueous solution are mixed, and emulsified by a homogenizer (manufactured by Nippon Seiki Co., Ltd.) at 8000 rpm for 7 minutes to obtain a photo-curable composition dispersion (1) in the form of an emulsion.

-Preparation of a Photo-Curable Composition Dispersion (2)-

A photo-curable composition dispersion (2) is prepared in the same manner as that of preparation of the photo-curable composition dispersion (1) except that photopolymerization initiators (1-a) and (1-b) are changed to 0.08 parts by mass of a photopolymerization initiator (2-a), 0.18 parts by mass of a photopolymerization initiator (2-b) and 0.18 parts by mass of a photopolymerization initiator (2-c).

-Preparation of a Photo-Curable Composition Dispersion (3)-

A photo-curable composition dispersion (3) is prepared in the same manner as that of the photo-curable composition dispersion (1) except that the photopolymerization initiator (2-b) used in the photo-curable composition dispersion (2) is changed to a photopolymerization initiator (3-b).

Chemical structural formulas of photopolymerization initiators (1-a), (1-b), (2-a), (2-b), (2-c) and (3-b), an electron accepting compound (1), and surfactants (1) and (2) used in preparation of photo-curable composition dispersions are shown below.

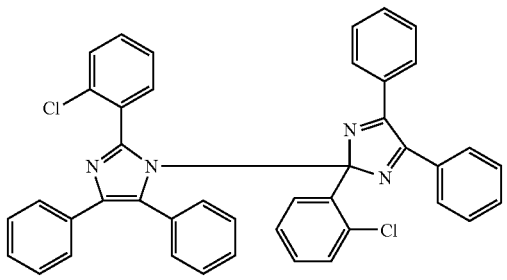

Photopolymerization initiator (1-a)

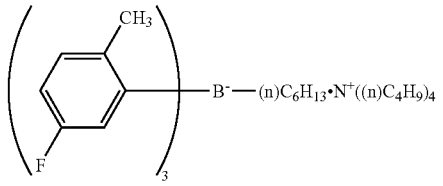

Photopolymerization initiator (1-b)

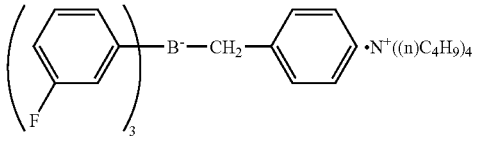

Photopolymerization initiator (2-a)

-continued

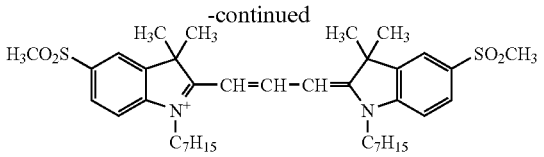

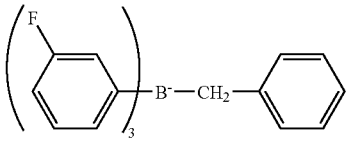

Photopolymerization initiator (2-b)

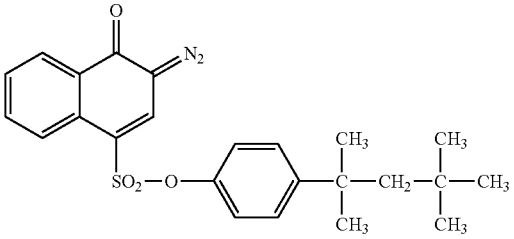

Photopolymerization initiator (2-c)

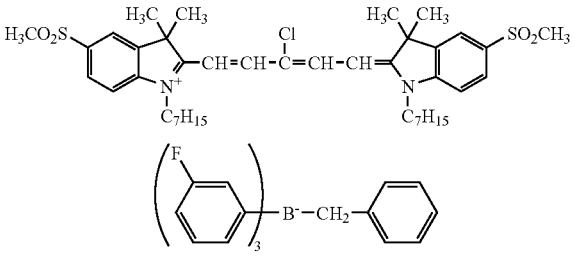

Photopolymerization initiator (3-b)

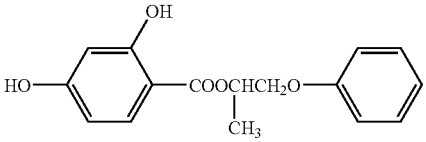

Electron accepting compound (1)

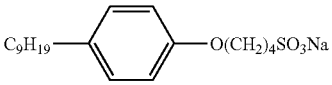

Surfactant (1)

$C_{12}H_{25}SO_3Na$

Surfactant (2)

-Preparation of Resin Particle Dispersion (1)-

Styrene: 360 parts by mass n-butyl acrylate: 40 parts by mass

Acrylic acid: 4 parts by mass

Dodecanethiol: 24 parts by mass

Carbon tetrabromide: 4 parts by mass

A solution in which the above are mixed and dissolved is dispersed and emulsified in a solution in which 6 parts by mass of a nonionic surfactant (trade name Nonipol 400: manufactured by Sanyo Chemical Industries, Ltd.) and 10 parts by mass of an anionic surfactant (trade name Neogen SC: manufactured by Dai-ichi Kogyo Seiyaku Co., Ltd.) are dissolved in 560 parts by mass of ion-exchanged water, in a flask, and while being slowly mixed for 10 minutes, a solution in which 4 parts by mass of ammonium persulfate is dissolved in 50 parts by mass of ion-exchanged water is added thereto.

After performing nitrogen replacement in the flask, the flask is heated with an oil bath while the interior of the flask is stirred until the content thereof becomes 70° C., and kept being subjected to emulsion polymerization for 5 hours.

A resin particle dispersion (1) (resin particle concentration: 30%) in which resin particles having a volume average particle diameter of 200 nm, a glass transition temperature of 50° C., a weight average molecular weight (Mw) of 16,200 and a specific gravity of 1.2 are dispersed is obtained.

-Preparation of Photosensitive/Thermosensitive Capsule Dispersion (1)-

Microcapsule dispersion (1): 24 parts by mass

Photo-curable composition dispersion (1): 232 parts by mass

The above are sufficiently mixed and dispersed with an Ultra Talax T50, manufactured by IKA Japan K.K., in a round-type stainless flask.

The pH is adjusted to 3 with nitric acid, then 0.20 parts by mass of polyaluminum chloride is added thereto and dispersing is continued for 10 minutes with the Ultra Talax at 6,000 rpm. The flask is heated to 40° C. with a heating oil bath while being slowly stirred.

Here, 60 parts by mass of a resin particle dispersion (1) is additionally added mildly.

Thereby, a photosensitive/thermosensitive capsule dispersion (1) is obtained.

The volume average particle diameter of the photosensitive/thermosensitive capsules dispersed in this dispersion is about 2 μm. Spontaneous color formation of the obtained dispersion is not observed.

-Preparation of Photosensitive/Thermosensitive Capsule Dispersion (2)-

A photosensitive/thermosensitive capsule dispersion (2) is prepared according to the same manner as that of the photosensitive/thermosensitive capsule dispersion (1), except that the microcapsule dispersion (1) is changed to a microcapsule dispersion (2), and the photo-curable composition dispersion (1) is changed to a photo-curable composition dispersion (2). The volume average particle diameter of photosensitive/thermosensitive capsules dispersed in this dispersion is about 2 μm. Spontaneous color formation of the obtained dispersion is not observed.

-Preparation of Photosensitive/Thermosensitive Capsule Dispersion (3)-

A photosensitive/thermosensitive capsule dispersion (3) is obtained according to the same manner as that of the photosensitive/thermosensitive capsule dispersion (1), except that the microcapsule dispersion (1) is changed to a microcapsule dispersion (3), and the photo-curable composition dispersion (1) is changed to a photo-curable composition dispersion (3). The volume average particle diameter of photosensitive/thermosensitive capsules dispersed in this dispersion is about 2 μm. Spontaneous color formation of the obtained dispersion is not observed.

-Preparation of Releasing Agent Particle Dispersion (1)-

Olefin wax (melting point: 85° C., specific gravity: 0.92): 90 parts by mass

Ionic surfactant (trade name Neogen RK, manufactured by Dai-ichi Kogyo Seiyaku Co., Ltd.): 1.8 parts by mass Ion-exchanged water: 210 parts by mass The above are heated to 100° C., and sufficiently dispersed with an Ultra Talax T50 manufactured by IKA Japan K.K., then subjected to a dispersing treatment with a pressure discharge-type Gaulin homogenizer for 1 hour while the dispersion is heated to 110° C., thereby a releasing agent particle dispersion (1) having a central diameter of 200 nm and a solid content amount of 30% is obtained.

-Preparation of Releasing Agent Particle Dispersion (2)-

Synthetic ester wax (melting point: 75° C., specific gravity: 0.95): 90 parts by mass Ionic surfactant (trade name Neogen RK, manufactured by Dai-ichi Kogyo Seiyaku Co., Ltd.): 1.8 parts by mass Ion-exchanged water: 210 parts by mass The above are heated to 100° C., and sufficiently dispersed with an Ultra Talax T50, manufactured by IKA Japan K.K., and subjected to a dispersing treatment with a pressure discharge-type Gaulin homogenizer for 1 hour while the dispersion is heated to 110° C., thereby a releasing agent particle dispersion (2) having a central diameter of 230 nm and a solid content amount of 30% is obtained.

Example 1

-Preparation of Toner (1)-

Photosensitive/thermosensitive capsule dispersion (1): 80 parts by mass

Photosensitive/thermosensitive capsule dispersion (2): 80 parts by mass

Photosensitive/thermosensitive capsule dispersion (3): 80 parts by mass

Resin particle dispersion (1): 80 parts by mass

The above are sufficiently mixed and dispersed with an Ultra Talax T50 manufactured by IKA Japan K.K. in a round-type stainless flask.

Next, 0.1 parts by mass of polyaluminum chloride is added, and dispersing with the Ultra Talax at a rotation number of 6,000 rpm is kept for 10 minutes. The flask is heated to 48° C. with a heating oil bath while being stirred. After being kept at 48° C. for 60 minutes, 20 parts by mass of a resin particle dispersion (1) is mildly added thereto.

The pH in the system is adjusted to 8.5 with a 0.5 mol/l sodium hydroxide aqueous solution, and the stainless flask is sealed and heated to 55° C. while being stirred using a magnetic seal, then retained for 10 hours.

After a reaction is completed, the reaction is cooled, filtered and sufficiently washed with ion-exchanged water, then solid-liquid separation according to Nutsche suction filtration is performed. This is further re-dispersed in 1 liter of ion-exchanged water at 40° C., then stirred and washed at 300 rpm for 15 minutes.

The washing process is further repeated five times, and when a pH of a filtrate becomes 7.5 and an electric conductivity becomes 7.0 μS/cmt, solid-liquid separation according to Nutsche suction filtration is performed using a No. 5A filter. Then, vacuum drying is performed for 12 hours to obtain a toner (1) having a structure in which three kinds of photosensitive/thermosensitive capsules are dispersed in a matrix.

The volume average particle diameter D50v of the resulting toner measured by a Coulter counter is about 15 μm. Spontaneous color formation is not observed.

100 parts by mass of the toner (1), 0.3 parts by mass of hydrophobic titania having an average particle diameter of 15 nm and having a surface treated with n-decyltrimethoxysilane, and 0.4 parts by mass of hydrophobic silica having an average particle diameter of 30 nm (trade name NY50, manufactured by Degussa Japan Co., Ltd.) are blended using a Henschel mixer, for 10 minutes at a circumferential rate of 32 m/s, and coarse particles are removed using a sieve having an opening of 45 μm to obtain an external additive-added toner (1) to which an external additive is added.

-Preparation of Carrier-

Ferrite particles (manufactured by Powdertech Co., Ltd., volume average particle diameter; 100 μm): 100 parts by mass Toluene: 14 parts by mass Perfluorooctylethyl acrylate/methyl methacrylate copolymer (copolymerization ratio=40:60, weight average molecular weight Mw=50,000): 0.8 parts by mass Carbon black (trade name VXC-72; manufactured by Cabot Japan K.K.): 0.06 parts by mass Crosslinking melamine resin particles (number average particle diameter; 0.3 μm): 0.15 parts by mass The above components except for ferrite particles are dispersed with a stirrer for 10 minutes to prepare a coating film forming solution, which is put into a vacuum evacuating-type kneader with the ferrite particles and stirred at 60° C. for 30 minutes, then the pressure is reduced to distill off the toluene to form a resin coating film on the surface of the ferrite particles, and thereby a carrier is prepared.

-Preparation of Developer- 96 parts by mass of a carrier and 4 parts by mass of an external additive-added toner (1) are stirred by a V-blender at 40 rpm for 20 minutes, then sieved with a sieve having an opening of 250 μm to prepare a developer (1).

-Assessment-

In a dark place, a developer (1) is put into a monochromic type image forming apparatus (black developing machine of an A color machine, manufactured by Fuji Xerox Co., Ltd.), then a toner image consisting of a 10 cm×10 cm bar and a thin line is formed and transferred onto a paper (a C2 paper manufactured by Fuji Xerox Co., Ltd.) to obtain an unfixed image (a toner image) which is not yet fixed.

This unfixed image is sequentially exposed in an image-wise manner with semiconductor laser light having a wavelength of 405 nm, semiconductor laser light having a wavelength of 535 nm, and semiconductor laser light having a wavelength of 657 nm. The unfixed image is fed through a separately prepared fixing machine of the copying machine for color formation and fixation. The fixing temperature of the fixing machine is 180° C., and the processing speed is 30 nm/sec. The obtained image is irradiated with a high-intensity Schaukasten having a luminance of 58,000 lux for 30 seconds.

The above image outputting is performed ten times in total. The toner in the developing machine is not destructed, the image, tone and gradation property are stable, and a highly precise full color image is obtained. There is no problem in fixability.

The obtained image is left for about half a year in a room of ordinary lighting environment, equipped with a fluorescent lamp on the ceiling. The image after being left is hardly discolored, and a longitudinal change in color balance is hardly observed.

Example 2

-Preparation of Toner (2)-

-Preparation of Photosensitive/Thermosensitive Capsule Dispersion (4)-

Microcapsule dispersion (1): 24 parts by mass

Photo-curable composition dispersion (1): 232 parts by mass

The above are sufficiently mixed and dispersed with an Ultra Talax T50, manufactured by IKA Japan K.K., in a round-type stainless flask.

The pH is adjusted to 3 with nitric acid, then 0.20 parts by mass of polyaluminum chloride is added thereto and dispersing is continued for 10 minutes with the Ultra Talax at a rotation number of 6,000 rpm. The dispersion is heated to 40° C. with a heating oil bath while the flask is slowly stirred.

60 parts by mass of a resin particle dispersion (1) is additionally added mildly. Thereafter, the pH in the flask is adjusted to 8.5 with a 0.5 mol/l sodium hydroxide aqueous solution, and the stainless flask is sealed and heated to 60° C. while being stirred using a magnetic seal, then retained for 7 hours to obtain a photosensitive/thermosensitive capsule dispersion (4). Thereafter, the obtained solution is taken out from the flask and allowed to cool.

The volume average particle diameter of photosensitive/thermosensitive capsules dispersed in the dispersion is about 10 μm. Spontaneous color formation of the obtained dispersion is not observed.

Microcapsule dispersion (2): 24 parts by mass

Photo-curable composition dispersion (2): 232 parts by mass

The above are sufficiently mixed and dispersed with an Ultra Talax T50, manufactured by IKA Japan K.K., in a round-type stainless flask, then the photosensitive/thermosensitive capsule dispersion (4) is added thereto.

The pH is adjusted to 3 with nitric acid, then 0.20 parts by mass of polyaluminum chloride is added thereto and dispersing is continued for 10 minutes with the Ultra Talax at a rotation number of 6,000 rpm. The dispersion is heated to 40° C. with a heating oil bath while the flask is slowly stirred.

Here, 60 parts by mass of a resin particle dispersion (1) is additionally added mildly. Thereafter, the pH in the flask is adjusted to 8.5 with a 0.5 mol/l sodium hydroxide aqueous solution, and the stainless flask is sealed and heated to 60° C. while being stirred using a magnetic seal, then retained for 7 hours to obtain a photosensitive/thermosensitive capsule dispersion (5). Thereafter, the obtained solution is taken out from the flask and allowed to cool.

The volume average particle diameter of photosensitive/thermosensitive capsules dispersed in the dispersion is about 13 μm. Spontaneous color formation of the resulting dispersion is not observed.

Subsequently,

Microcapsule dispersion (3): 24 parts by mass

Photo-curable composition dispersion (3): 232 parts by mass

The above are sufficiently mixed and dispersed with an Ultra Talax T50, manufactured by IKA Japan K.K., in a round-type stainless flask, then the photosensitive/thermosensitive capsule dispersion (5) is added thereto.

The pH is adjusted to 3 with nitric acid, then 0.20 parts by mass of polyaluminum chloride is added thereto and dispersing is continued for 10 minutes with the Ultra Talax at a rotation number of 6,000 rpm. The dispersion is heated to 40° C. with a heating oil bath while the flask is slowly stirred.

60 parts by mass of a resin particle dispersion (1) is additionally added mildly. Thereafter, the pH in the flask is adjusted to 8.5 with a 0.5 mol/l sodium hydroxide aqueous solution, and the stainless flask is sealed and heated to 60° C. while being stirred using a magnetic seal, then retained for 7 hours to obtain a photosensitive/thermosensitive capsule dispersion (6). Here, particles in the dispersion are to be toner particles.

The volume average particle diameter of photosensitive/thermosensitive capsules dispersed in the dispersion is about 15 μm. Spontaneous color formation of the resulting dispersion is not observed.

After a reaction is completed, the reaction is cooled, filtered and sufficiently washed with ion-exchanged water, then solid-liquid separation according to Nutsche suction filtration is performed. This is further re-dispersed in 3 liter of ion-exchanged water at 40° C. in a 5-liter beaker, then stirred and washed at 300 rpm for 15 minutes.

The washing process is further repeated five times, and solid-liquid separation according to Nutsche suction filtration is performed, then lyophilization is performed in vacuum for 12 hours to obtain toner particles.

1.0 part by mass of hydrophobic silica (trade name TS720, manufactured by Cabot Japan K.K.) is added to 50 parts by mass of the above toner particles, and mixed using a sample mill to obtain an external additive-added toner.

-Preparation of Developer-

By using a ferrite carrier having an average particle diameter of 50 μm and having the surface covered with polymethyl methacrylate (manufactured by Soken Chemical & Engineering Co., Ltd.), where the amount of polymethyl methacrylate used with respect to the total mass of the carrier is 1% by mass, the external additive-added toner is weighed so that the concentration of the toner is 5% by mass, then both are stirred and mixed with a ball mill for 5 minutes to prepare a developer (2).

-Assessment-

In a dark place, a developer (2) is put into a monochromic type image forming apparatus (black developing machine of an A color machine, manufactured by Fuji Xerox Co., Ltd.), then a toner image consisting of a 10 cm×10 cm bar and a thin line is formed and transferred onto a paper (a C2 paper manufactured by Fuji Xerox Co., Ltd.) to obtain an unfixed image (a toner image) which is not yet fixed.

This unfixed image is sequentially subjected to imagewise exposure with semiconductor laser light having a wavelength 405 nm, then semiconductor laser light having a wavelength of 535 nm, and further with semiconductor laser light having a wavelength of 657 nm. The unfixed image is fed through a separately prepared fixing machine of the copying machine for color formation and fixation. The fixing temperature of the fixing machine is 180° C. and the processing speed is 30 nm/sec. The resulting image is irradiated with a high-intensity Schaukasten having a luminance of 58,000 lux for 30 seconds.

The above image outputting is performed ten times in total. The toner in the developing machine is not destructed, the image, tone and gradation property are stable, and a highly precise full color image is obtained. There is no problem in fixability.

The resulting image is left for about half a year in a room of ordinary lighting environment, equipped with a fluorescent lamp on the ceiling. The image after being left is hardly discolored, and a longitudinal change in color balance is hardly observed.

Example 3

-Preparation of Toner (3)-

Microcapsule dispersion (1): 50 parts by mass

Photo-curable composition dispersion (1): 400 parts by mass

Polyaluminum chloride: 0.20 parts by mass

Ion exchanged water: 300 parts by mass

After the above components are sufficiently mixed and dispersed with a homogenizer (trade name Ultra Talax T50, manufactured by IKA Japan K.K.), where the pH thereof is adjusted to 3.5 with nitric acid, then transferred into a round-type stainless flask. The dispersion is heated to 43° C. with a heating oil bath while being stirred with a three-one motor, and retained at 43° C. for 60 minutes. Further, 150 parts by mass of a resin particle dispersion (1) is added and slowly stirred.

Thereafter, the pH in the flask is adjusted to 5.0 with 0.5 mol/liter of a sodium hydroxide aqueous solution, and heated to 55° C. while being stirred. Furthermore, this is retained at 55° C. for 3 hours. While raising the temperature to 55° C. and retaining, a pH in a flask is reduced to 5.0 or lower, conventionally. However, the pH here is retained so as not to go under 4.5 by additionally dropping a sodium hydroxide aqueous solution.

After a reaction is completed, the reaction is cooled, filtered and sufficiently washed with ion-exchanged water, then solid-liquid separation according to Nutsche suction filtration is performed. This is further re-dispersed in 3 liter of ion-exchanged water at 40° C. in a 5-liter beaker, then stirred and washed at 300 rpm for 15 minutes.

The washing process is further repeated five times, and solid-liquid separation according to Nutsche suction filtration is performed, then lyophilization is performed in vacuum for 12 hours to obtain toner particles. Spontaneous color formation is not observed during the period of forming the toner particles.

The volume average particle diameter D50v of the resulting toner particles measured by a Coulter counter is 14 μm.

0.8 parts by mass of hydrophobic silica (trade name TS720, manufactured by Cabot Japan K.K.) is added to 50 parts by mass of the above toner particles, and mixed using a sample mill to obtain an external additive-added toner.

-Preparation of Developer-

By using a ferrite carrier having an average particle diameter of 50 μm and having the surface covered with polymethyl methacrylate (manufactured by Soken Chemical & Engineering Co., Ltd.), where the amount of polymethyl methacrylate used with respect to the total mass of the carrier is 1% by mass, the external additive-added toner is weighed so that the concentration of the toner is 5% by mass, then both are stirred and mixed with a ball mill for 5 minutes to prepare a developer (3).

-Assessment-

In a dark place, a developer (3) is put into a monochromic type image forming apparatus (black developing machine of an A color machine, manufactured by Fuji Xerox Co., Ltd.), then a toner image consisting of a 10 cm×10 cm bar and a thin line is formed and transferred onto a paper (a C2 paper, manufactured by Fuji Xerox Co., Ltd.) to obtain an unfixed image (a toner image) which is not yet fixed.

This unfixed image is subjected to imagewise exposure with semiconductor laser light having a wavelength 405 nm, then fed through a separately prepared fixing machine of the copying machine for color formation and fixation. The fixing temperature of the fixing machine is 180° C. and the processing speed is 30 nm/sec. The resulting image is irradiated with a high-intensity Schaukasten having a luminance of 58,000 lux for 30 seconds.

The above image outputting is performed ten times in total. The toner in the developing machine is not destructed, the image, tone and gradation property are stable, and a highly precise full color image is obtained. There is no problem in fixability.

The image after subjected to light irradiation with a Schaukasten having a high luminance is left for about half a year in a room of ordinary illumination environment, equipped with a fluorescent lamp on the ceiling. The image after being left is hardly discolored, and a longitudinal change in color balance is hardly observed.

Example 4

A developer (4) is obtained by preparing a toner and a developer according to the same manner as that of Example 3 except that a microcapsule dispersion (2) and a photo-curable composition dispersion (2) are used in place of the microcapsule dispersion (1) and the photo-curable composition dispersion (1). Spontaneous color formation is not observed during the period of granulating the toner particles. The volume average particle diameter D50v of the toner particles measured with a Coulter counter is 13 μm.

Subsequently, the same assessment as that of Example 3 is performed in a dark place, except that a developer (4) is used in place of the developer (3). The wavelength of semiconductor laser light used for irradiation is 535 nm.

The above image outputting is performed ten times in total. The toner in the developing machine is not destructed, the image, tone and gradation property are stable, and a highly precise full color image is obtained. There is no problem in fixability.

The image after subjected to light irradiation with a high-intensity Schaukasten is left for about half a year in a room of ordinary lighting environment, equipped with a fluorescent lamp on the ceiling. The image after being left is hardly discolored, and a longitudinal change in color balance is hardly observed.

Example 5

A developer (5) is obtained by preparing a toner and a developer according to the same manner as that of Example 3 except that a microcapsule dispersion (3) and a photo-curable composition dispersion (3) are used in place of the microcapsule dispersion (1) and the photo-curable composition dispersion (1). Spontaneous color formation is not observed during the period of granulating the toner particles. The volume average particle diameter D50v of the toner particles measured with a Coulter counter is 15 μm.

Subsequently, the same assessment as that of Example 3 is performed in a dark place, except that a developer (5) is used in place of the developer (3). The wavelength of semiconductor laser light used for irradiation is 657 nm.

The above image outputting is performed ten times in total. The toner in the developing machine is not destructed, the image, tone and gradation property are stable, and a highly precise full color image is obtained. There is no problem in fixability.

The image after subjected to light irradiation with a high-intensity Schaukasten is left for about half a year in a room of ordinary illumination environment, equipped with a fluorescent lamp on the ceiling. The image after being left is hardly discolored, and a longitudinal change in color balance is hardly observed.

-Method of Measuring Toner Particle Size and Particle Size Distribution-

A particle size and a particle size distribution of a toner are measured using a Coulter counter TA-II type (manufactured by Beckmann-Coulter, Inc.) as a measuring apparatus, and ISOTON-II (manufactured by Beckmann-Coulter, Inc.) as an electrolysis solution.

0.5 to 50 mg of a measuring sample is added to 2 ml of a 5% aqueous solution of a surfactant, preferably sodium alkylbenzenesulfonate, as a dispersing agent. This is added to 100 to 150 ml of the electrolysis solution. The electrolysis solution in which the sample is suspended is subjected to dispersion with a supersonic dispersing equipment for about 1 minute. The particle size distribution of the particles having a diameter of 2 to 60 μm is measured with the Coulter counter TA-II type using an aperture having an aperture diameter of 100 μm, then a volume average particle diameter is calculated in the above-described manner. The number of particles to be measured is 50,000.

-Volume Average Particle Diameter of Fine Particles-

The volume average particle diameter of various fine particles other than the toner particles is measured with a laser scattering diffraction method particle size distribution analyzer (trade name LS 13 320, manufactured by Beckmann-Coulter, Inc.).

-Method of Measuring Glass Transition Temperature of Resin and Toner-

A glass transition temperature of various resin materials used in preparation of a toner is calculated as a temperature at the intersection of extension lines of a baseline and a starting line at an endothermic part, in compliance with ASTMD3418-8. A differential scanning calorimeter (trade name DSC-50, manufactured by Shimadzu Corporation) is used for measurement.

All publications, patent applications, and technical standards mentioned in this specification are herein incorporated by reference to the same extent as if each individual publication, patent application, or technical standard was specifically and individually indicated to be incorporated by reference.

What is claimed is:

1. A toner for electrostatic latent image development comprising:

a first component and a second component which are isolated from each other and capable of forming a color when the first component and the second component are brought into reaction with each other, and a photo-curable composition, wherein the toner is substantially colorless when the photo-curable composition is not cured, and is irreversibly controlled to develop a color by irradiating light having a wavelength at which the photo-curable composition is cured, and then heating after the irradiation, the photo-curable composition contains microcapsules which are dispersed therein, the first component is contained in the microcapsules and the second component is contained in the photo-curable composition, and the microcapsules comprise outer shells formed from a thermoplastic resin having a glass transition temperature of from 90 to 200° C.

2. The toner for electrostatic latent image development according to claim 1, wherein the microcapsules are thermoreactive microcapsules which enables substance diffusion between inside and outside the microcapsules by a heating treatment.

3. The toner for electrostatic latent image development according to claim 1, wherein the microcapsules comprise a core part which contains the first component.

4. The toner for electrostatic latent image development according to claim 1, wherein the photo-curable composition contains a photo-polymerizable compound.

5. The toner for electrostatic latent image development according to claim 1, wherein the toner comprises two or more color forming sections comprising the photo-curable composition and microcapsules which are dispersed in the photo-curable composition.

6. The toner for electrostatic latent image development according to claim 5, wherein the two or more color forming sections comprise two or more kinds of color forming sections which are capable of forming different colors from each other.

7. The toner for electrostatic latent image development according to claim 6, wherein the two or more color forming sections comprise a yellow color forming section which is capable of forming yellow, a magenta color forming section which is capable of forming magenta, and a cyan color forming section which is capable of forming cyan.

8. The toner for electrostatic latent image development according to claim 5, wherein the toner comprises a base material comprising a bonding resin as a major component and each of the two or more color forming sections are dispersed in the base material in the form of particles.

9. The toner for electrostatic latent image development according to claim 8, wherein the color forming sections which are dispersed in the form of particles comprise a core part and an outer shell that coats the core part, the outer shell containing a material which is insoluble in water.

10. The toner for electrostatic latent image development according to claim 5, wherein at least one of the two or more color forming sections is in contact adjacently with at least one of the other color forming sections so as to form an interface.

11. The toner for electrostatic latent image development according to claim 10, wherein a layer comprising a non-water-soluble material is formed at the interface of the one color forming section and the other color forming sections.

12. The toner for electrostatic latent image development according to claim 1, wherein the shell is formed from an amorphous resin or a crystalline resin.

13. A method of producing a toner utilizing a wet method, the toner comprising:

a first component and a second component which are isolated from each other and capable of forming a color when the first component and the second component are brought into reaction with each other, and a photo-curable composition, wherein the toner is substantially colorless when the photo-curable composition is not cured, and is irreversibly controlled to develop a color by irradiating light having a wavelength at which the photo-curable composition is cured, and then heating after the irradiation, the photo-curable composition contains microcapsules which are dispersed therein, the first component is contained in the microcapsules and the second component is contained in the photo-curable composition, and the microcapsules comprise outer shells formed from a thermoplastic resin having a glass transition temperature of from 90 to 200° C.

14. The method of producing a toner according to claim 13, wherein the wet method includes an emulsion aggregation method.

15. The method of producing a toner according to claim 13, wherein the highest processing temperature in the wet method is approximately 90° C. or less.

16. The method of producing a toner according to claim 13, wherein the method comprises a process to prepare two or more photosensitive/thermosensitive capsule dispersions which are capable of forming different colors from each other, each dispersion being formed by a process comprising:

a first aggregating process wherein first aggregated particles are formed in a raw material dispersion comprising a microcapsule dispersion in which microcapsules containing a first component are dispersed and a photo-curable composition dispersion in which a photo-curable composition containing a second component is dispersed;

an attaching process wherein resin particles are attached to the surface of the first aggregated particles by adding a first resin particle dispersion in which the resin particles are dispersed to the raw material dispersion in which the first aggregated particles are formed; and a first fusing process wherein the raw material dispersion containing the first aggregated particles having the resin particles which are attached to the surface thereof is heated to fuse the first aggregated particles, and the method further comprising:

a second aggregating process wherein second aggregated particles are formed in a mixed solution in which the two or more photosensitive/thermosensitive capsule dispersions and a second resin particle dispersion in which resin particles are dispersed are mixed; and a second fusing process in which a second fused particles are obtained by heating the mixed solution containing the second aggregated particles, thereby forming the toner.

17. The method of producing a toner according to claim 13, wherein the method comprises a process to prepare a photosensitive/thermosensitive capsule dispersion, the process comprising:

a first aggregating process wherein first aggregated particles are formed in a raw material dispersion comprising a first microcapsule dispersion in which microcapsules containing a first component are dispersed and a first photo-curable composition dispersion in which a photo-curable composition containing a second component is dispersed;

an attaching process wherein resin particles are attached to the surface of the first aggregated particles by adding a first resin particle dispersion in which the resin particles are dispersed to the raw material dispersion in which the first aggregated particles are formed; and a first fusing process wherein photosensitive/thermosensitive capsules are obtained by heating the raw material dispersion containing the first aggregated particles having the resin particles which are attached to the surface thereof to fuse the first aggregated particles, and the method further comprising:

a photosensitive/thermosensitive layer forming process wherein a photosensitive/thermosensitive layer capable of forming a color which is different from the color of the photosensitive/thermosensitive capsules is formed on the surface of the photosensitive/thermosensitive capsules by adding a raw material dispersion comprising a second microcapsule dispersion in which microcapsules containing a first component is dispersed and a second photo-curable composition dispersion in which a photo-curable composition containing a second component, to the photosensitive/thermosensitive capsule dispersion;

a coating layer forming process wherein the resin particles are attached to the surface of the photosensitive/thermosensitive layer to form a coating layer by adding a second resin particle dispersion in which resin particles are dispersed to the raw material dispersion which has undergone the photosensitive/thermosensitive layer forming process; and a second fusing process in which fused particles are obtained by heating the raw material dispersion containing a second aggregated particles on which the coating layer is formed by attaching the resin particles to the surface of the photosensitive/thermosensitive layer, thereby forming the toner.

18. The method of producing a toner according to claim 17, wherein the process in which the photosensitive/thermosensitive layer forming process, the coating layer forming process and the second fusing process are conducted in this order is further repeated one or more times, and the colors of the two or more photosensitive/thermosensitive layers which are formed by respective photosensitive/thermosensitive layer forming processes and the photosensitive/thermosensitive capsules are different from each other.

19. A method of producing a toner containing a color-changeable substance, wherein the toner is produced by utilizing a wet method, the color-changeable substance comprising:

a first component and a second component which are isolated from each other and capable of forming a color when the first component and the second component are brought into reaction with each other, and a photo-curable composition containing, wherein the toner is substantially colorless when the photo-curable composition is not cured, and is irreversibly controlled to develop a color by irradiating light having a wavelength at which the photo-curable composition is cured, and then heating after the irradiation, the photo-curable composition contains microcapsules which are dispersed therein, the first component is contained in the microcapsules and the second component is contained in the photo-curable composition, and the microcapsules comprise outer shells formed from a thermoplastic resin having a glass transition temperature of from 90 to 200° C.

20. The method of producing a toner according to claim 19, wherein the wet method includes an emulsion aggregation method.

21. The method of producing a toner according to claim 20, wherein the highest processing temperature in the wet method is approximately 90° C. or less.

22. A developer for electrostatic latent image development containing a toner comprising:

a first component and a second component which are isolated from each other and capable of forming a color when the first component and the second component are brought into reaction with each other, and a photo-curable composition, wherein the toner is substantially colorless when the photo-curable composition is not cured, and is irreversibly controlled to develop a color by irradiating light having a wavelength at which the photo-curable composition is cured, and then heating after the irradiation, the photo-curable composition contains microcapsules which are dispersed therein, the first component is contained in the microcapsules and the second component is contained in the photo-curable composition, and the microcapsules comprise outer shells formed from a thermoplastic resin having a glass transition temperature of from 90 to 200° C.

23. The toner for electrostatic latent image development according to claim 1, wherein the shell is formed from a thermoplastic resin having a glass transition temperature of from 100 to 150° C.

24. The method for producing a toner according to claim 13, wherein the shell is formed from a thermoplastic resin having a glass transition temperature of from 100 to 150° C.

25. The method for producing a toner according to claim 12, wherein the shell is formed from a thermoplastic resin having a glass transition temperature of from 100 to 150° C.

26. The developer according to claim 22, wherein the shell is formed from a thermoplastic resin having a glass transition temperature of from 100 to 150° C.

27. The method for producing a toner according to claim 13, wherein the shell is formed from an amorphous or crystalline resin.

28. The method for producing a toner according to claim 19, wherein the shell is formed from an amorphous or crystalline resin.

29. The developer according to claim 22, wherein the shell is formed from an amorphous or crystalline resin.

* * * * *